US005090573A

United States Patent [19]

Takahashi et al.

[11] Patent Number: 5,090,573

[45] Date of Patent: Feb. 25, 1992

[54] PAPER SHEET BUNDLE PROCESSING APPARATUS

[75] Inventors: Hitoshi Takahashi; Toshinori Adachi, both of Yokohama, Japan

[73] Assignee: Kabushiki Kaisha Toshiba, Kanagawa, Japan

[21] Appl. No.: 497,966

[22] Filed: Mar. 23, 1990

[30] Foreign Application Priority Data

Mar. 31, 1989 [JP] Japan ..... 1-81786

[51] Int. Cl.[5] ..... B07C 5/02; B65B 61/04

[52] U.S. Cl. ..... 209/534; 29/33.52; 29/426.3; 29/564.3; 83/909; 414/412

[58] Field of Search ..... 209/534, 551; 29/33.52, 29/426.3, 426.4, 564.3; 83/909; 414/412

[56] References Cited

U.S. PATENT DOCUMENTS 4,236,639 12/1980 Boettge et al. ..... 209/534
4,404,723 9/1983 Ohba et al. ..... 83/909 X
4,414,730 11/1983 Ohmura et al. ..... 209/534 X
4,483,124 11/1984 Ohba et al. ..... 209/534 X
4,553,312 11/1985 Mitzel et al. ..... 83/909 X
4,586,232 5/1986 Ohmura et al. ..... 209/534 X
4,660,818 4/1987 Conner et al. ..... 209/534 X
4,722,443 2/1988 Maruyama et al. ..... 209/534
4,845,917 7/1989 Omura et al. ..... 209/534 X
5,012,932 5/1991 Omura et al. ..... 209/534

FOREIGN PATENT DOCUMENTS 0302458 2/1989 European Pat. Off. ..... 209/534
64-38893 2/1989 Japan .

*Primary Examiner*—Michael S. Huppert
*Assistant Examiner*—Edward M. Wacyra
*Attorney, Agent, or Firm*—Cushman, Darby & Cushman

[57] ABSTRACT

A paper sheet bundle processing apparatus. The apparatus receives a bundle of sheaves bound with large bands. Each sheaf within the bundle is bound with a small band. The bundle is moved to a band removing section where the large bands are removed. The bundle is then moved to a sheaf extracting section where each sheaf is extracted from the bundle one at a time. A band removing apparatus removes the small band from each sheaf thus allowing the paper sheets to be removed individually.

13 Claims, 28 Drawing Sheets

PAPER SHEET BUNDLE PROCESSING APPARATUS

BACKGROUND OF THE INVENTION

1. Field of the Invention

This invention relates to a paper sheet bundle processing apparatus, and more particularly to an apparatus that receives bundles of paper sheets (e.g. bank notes), removes large bands from the thus received bundles, and produces sheaves individually bound with a small band.

2. Description of the Related Art

In a conventional bank note inspection processing system, a paper sheet bundle processing apparatus has been employed. The apparatus receives bundles having a prescribed number of sheaves, each of the sheaves having a prescribed number of bank notes. The apparatus then removes large bands from the thus received bundles so as to release the sheaves. Further, the apparatus extracts sheaves one at a time from the released sheaves. The procedures performed by the apparatus will be briefly described with reference to FIG. 29, and is disclosed in Japanese Laid Open Patent SHO 64-38893. Specifically, the apparatus receives a bundle T bound with a vertical large band K1 and a horizontal large band K2. The bands K1 and K2 are cut by a vertical band cutter 1101 and a horizontal band cutter 1102, respectively. The bands K1 and K2, which have been cut, are sandwiched and pulled away by catches 1103 and 1104, respectively. As a result, the bands K1 and K2 are removed. After the removal of the bands K1 and K2, a sheaf H is extracted from the thus released sheaves. The extracted sheaf H has a small band K, which is to be removed in the subsequent process. However, the bands K1 and K2 cannot be completely removed only by the catches 1103 and 1104. Thus, the residue of the bands K1 and K2 are inevitably sent to the subsequent small band removing process. As a result, the residue of the bands K1 and K2 have some adverse effects on the small band removing process.

Further, in the above-described conventional apparatus, the prescribed steps such as receiving the bundle T, cutting the vertical and horizontal bands K1 and K2, removing the thus cut bands, and extracting a sheaf one by one from the released sheaves are performed as a series of processes. Moreover, in the conventional apparatus, a subsequent bundle cannot be received until the prescribed processing of the preceding bundle has ended. Thus, even a small failure or delay in any process inevitably causes the entire process to slow or at worst be stopped. As a result, the efficiency of bank note processing has been extremely low.

SUMMARY OF THE INVENTION

Accordingly, one object of the present invention is to provide a paper sheet bundle processing apparatus that can completely remove large bands from bundles so as to avoid adverse effects on the subsequent processes.

Briefly, in accordance with one aspect of this invention, there is provided a paper sheet bundle processing apparatus for processing received bundles bound with large bands, each bundle having a prescribed number of sheaves bound, each sheaf being bound with a small band. The apparatus comprises a large band removing section that receives the bundles and removes the large bands therefrom, a sheaf storing section that temporarily stores a prescribed number of sheaves such that the sheaves are released from the bundles when the large bands have been removed by the large band removing section, and a sheaf extracting section that receives a prescribed number of sheaves from the sheaf storing section and extracts a sheaf one by one from the received sheaves.

BRIEF DESCRIPTION OF THE DRAWINGS

A more complete appreciation of the invention and many of the attendant advantages thereof will be readily obtained with reference to the following detailed description when considered in connection with the accompanying drawings, wherein.

DESCRIPTION OF THE PREFERRED EMBODIMENTS

Figure 1:
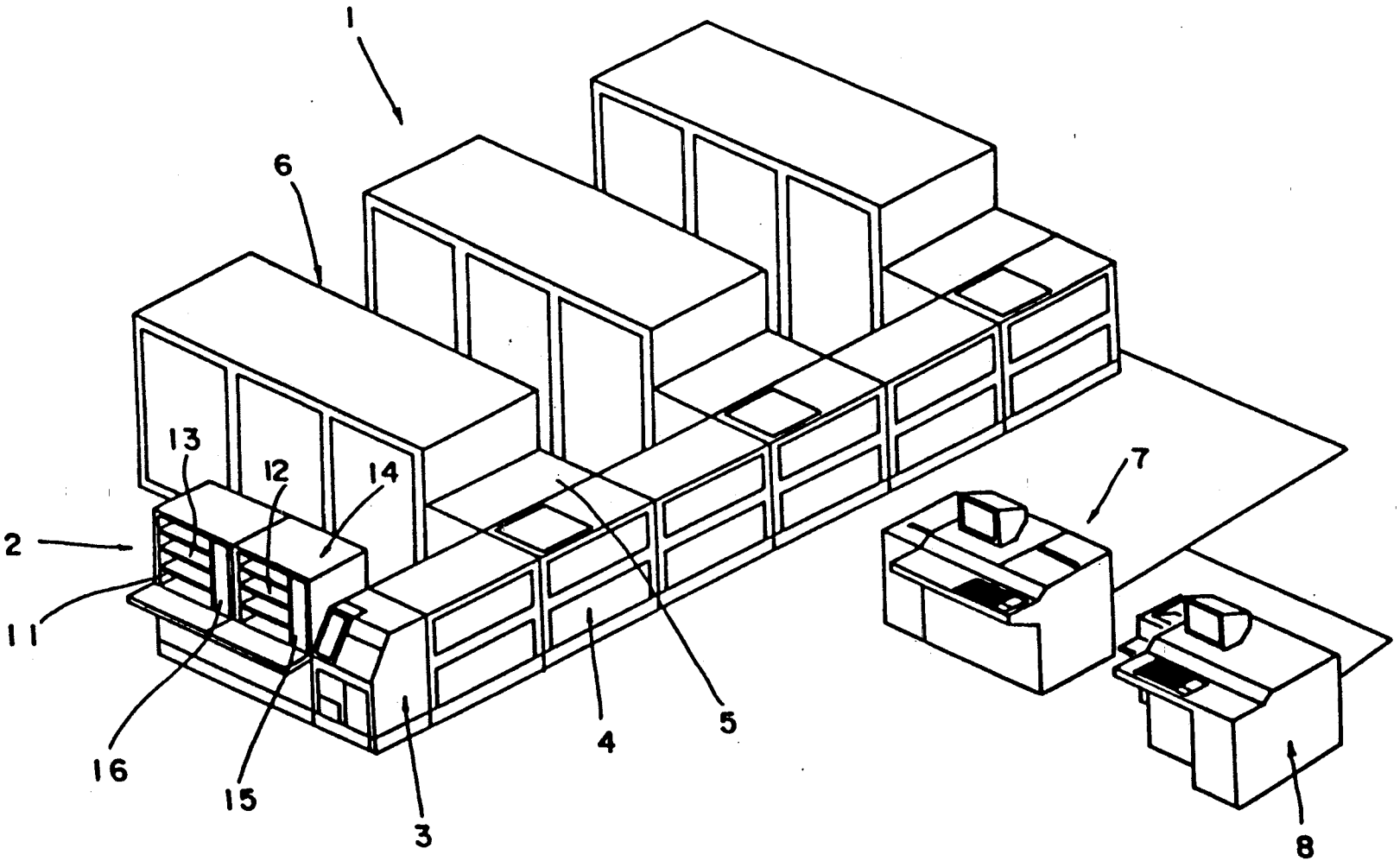
FIG. 1 is a schematic perspective view illustrating a bank note inspection processing system including an apparatus of one embodiment according to the present invention.

Referring now to the drawings, wherein like reference numerals designate identical or corresponding parts throughout the several views, and more particularly to FIG. 1 thereof, one embodiment of this invention will be described.

First, the entire configuration of a bank note inspection processing system wherein a bank note bundle processing apparatus of this invention is employed will be described.

In FIG. 1, a bank note inspection processing system 1 comprises a bank note bundle conveyance processing apparatus 2. The apparatus 2 stores and distributes uninspected bank note bundles, and also receives inspected bank note bundles (hereinafter, simply referred to as a bundle). The system 1 further comprises a bundle rejection unit 3, a bundle conveyance unit 4, a pre-processing apparatus 5 and a bank note inspection apparatus 6. The unit 3 rejects uninspected bundles being carried out from the apparatus 2. The unit 4 conveys the bundles rejected by the unit 3 toward the apparatus 5. In the apparatus 5, large bands are removed from the bundles, and small bands are removed from the sheaves. The apparatus 6 receives bank notes from the apparatus 5, and inspects the same in accordance with prescribed procedures. Thereafter, the apparatus 6 packages the thus inspected bank notes with bands, and produces the same as inspected bundles. Further, the system 1 comprises a bank note-discarding processor 7 and a central control apparatus 8. The processor 7 receives bank notes unfit to reuse which are discharged from the apparatus 6. The processor 7 then processes the unfit bank notes into a state so that they can be discarded. The apparatus 8 controls the operation of the entire system, and also totals the inspected bank notes.

The apparatus 2 comprises an uninspected bundle storing unit 12 and an inspected bundle storing unit 13, both having plurality of shelves 11. The apparatus 2 further comprises a bundle carrying-out section 15, a bundle carrying-in section 16 and a bundle conveyance section (not shown).

Figure 2:
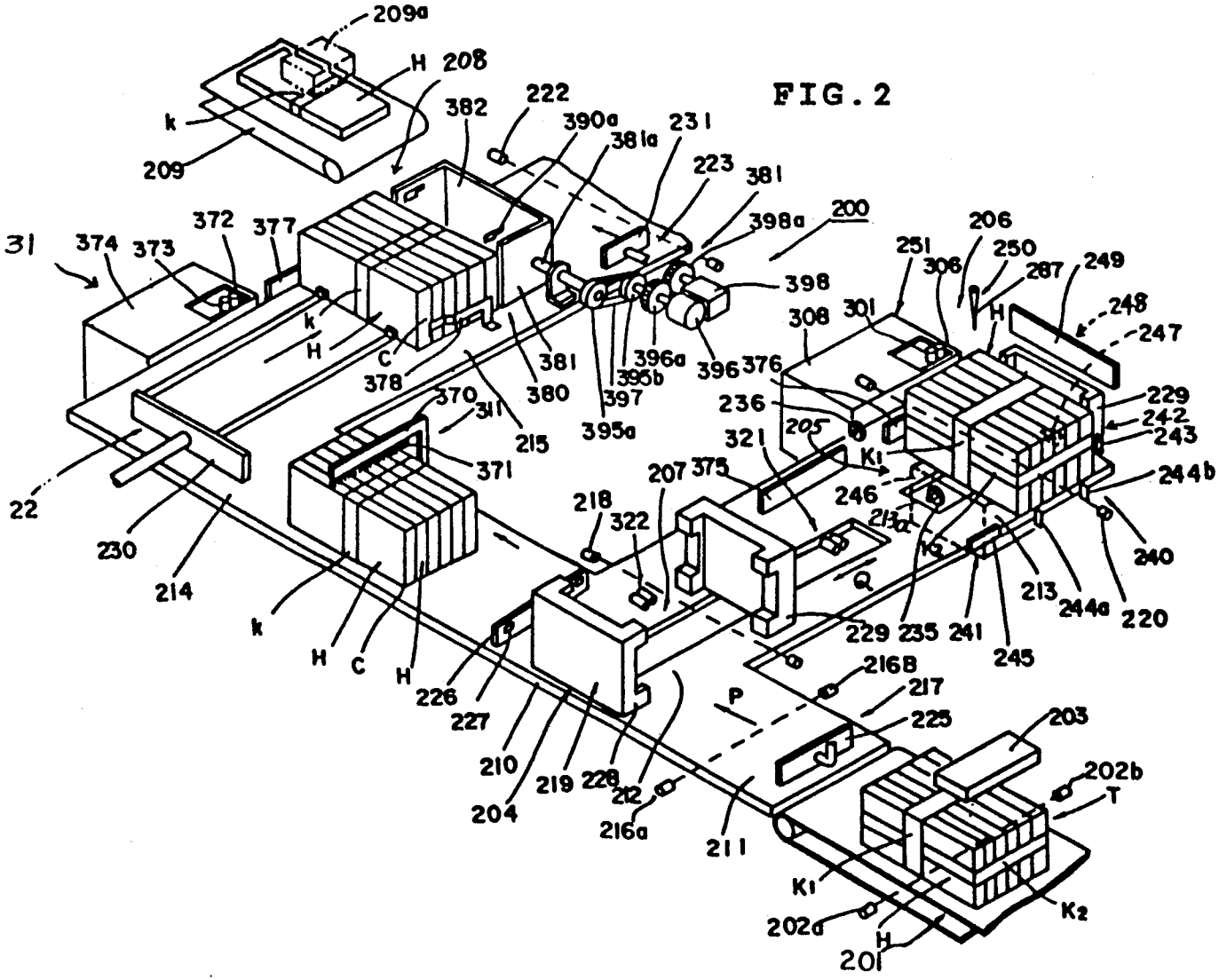
FIG. 2 is a perspective view illustrating the apparatus of this invention.

A bank note bundle processing apparatus 200 of one embodiment according to the present invention will be described with reference to FIGS. 2 through 10. In FIG. 2, the bank note bundle processing apparatus 200 comprises a bundle carrying-in section 201, a first bundle sensor 202, a large band printer 203 and a conveyance section 204. The apparatus 200 further comprises a band cutting section 205, a band removing section 206, a sheaf storing section 207, a sheaf extracting section 208 and a sheaf carring-out section 209. The section 201 includes a belt conveyor that carries in bank note bundles T. The bundle sensor 202 includes a light emitting element 202*a* and a light receiving element 202*b*, and detects the bundles T in the section 201. The printer 203 is disposed at the upper portion of the section 201, and prints bank names and the like on the vertical bands K1 of the bundles T. The section 204 conveys bundles T and a prescribed number of sheaves H. The section 205 cuts a vertical band K1 and a horizontal band K2, both of a bundle T. The section 206 removes the bands K1 and K2 from the bundle T. The section 207 temporarily stores a prescribed number of sheaves H released from the bundle T whose bands K1 and K2 have been removed. The section 208 extracts a sheaf H one by one from the sheaves stored in the section 207. The section 209 carries out the thus extracted sheaf H. The section 209 is provided with a small band printer 209*a*.

The conveyance section 204 comprises a base 210, a second bundle sensor 216, a first transfer unit 217, a third bundle sensor 218, and a second transfer unit 219. Further, the section 204 comprises a third bundle sensor 220, a third transfer unit 221, a fourth sensor 222, and a fourth transfer 223. The base 210 has a flat surface and is disposed between the bundle carrying-in section 201 and the sheaf carrying-out section 209. The base 210 includes a bundle receiving region 211, a direction changing region 212, a bundle processing region 213, a sheaf processing region 214 and a sheaf storing region 215, which are continuously formed so as to be a substantially F-shaped structure. The first bundle sensor 216 has a light-emitting element 216*a* and a light receiving element 216*b*, and detects the presence of the bundle T in the bundle receiving region 211. The first transfer unit 217 transfers bundle T from the region 211 to the region 212, and also transfers the sheaves H from the region 212 to the region 214. The second bundle sensor 218 detects the presence of bundle T in the region 212. The second transfer unit 219 transfers bundle T and a prescribed number of sheaves H from the region 212 to the region 213. The third bundle sensor 220 detects the presence of bundle T at the end of the region 213. The third transfer unit 221 transfer the sheaves H from the region 214 to the region 215. The fourth sensor 222 detects the presence of the sheaves of bank notes C in the region 215. The fourth transfer unit 223 transfers a sheaf of bank notes C to the sheaf carrying-out section.

The first transfer unit 217 comprises a first sweeper 225 and a movable wall 226. The first sweeper 225 is driven by a driving unit (not shown) in a direction of arrow P. The movable wall 226 is provided opposing the first sweeper 225 in the region 212, and moves linearly in a direction of arrow P, i.e., toward the region 214. The movable wall 226 has positioning members 227 that come in contact with the end face of bundle T or sheaves H. The second transfer unit 219 comprises a pair of first and second transfers 228 and 229, and a transfer moving unit (not shown) in the region 212. The transfers 228 and 229 are substantially U-shaped, and movably disposed opposing each other. The transfers 228 and 229 are moved by the transfer moving unit in a direction of arrow Q (perpendicular to arrow P). In other words, the transfers 228 and 229 reciprocate between the region 212 and the bundle processing region 213. The third transfer unit 221 comprises a third transfer 230 and a transfer moving unit (not shown). The fourth transfer unit 223 comprises a fourth transfer 231 and a transfer moving unit (not shown). The sheaf storing section 207 comprises the region 212, the first transfer unit 217, the second transfer unit 219 and a second bundle sensor 218.

More specifically, the band cutting section 205 and the band removing section 206 will be described with reference to FIGS. 2 through 8. The band cutting section 205 comprises a vertical band cutter 235 and a horizontal band cutter 236. The cutter 235 is moved up and down in a vertical line so as to cut the band K1 of bundle T. The cutter 236 is caused to reciprocate in a horizontal direction so as to cut the band K2 of bundle T.

Figure 4:
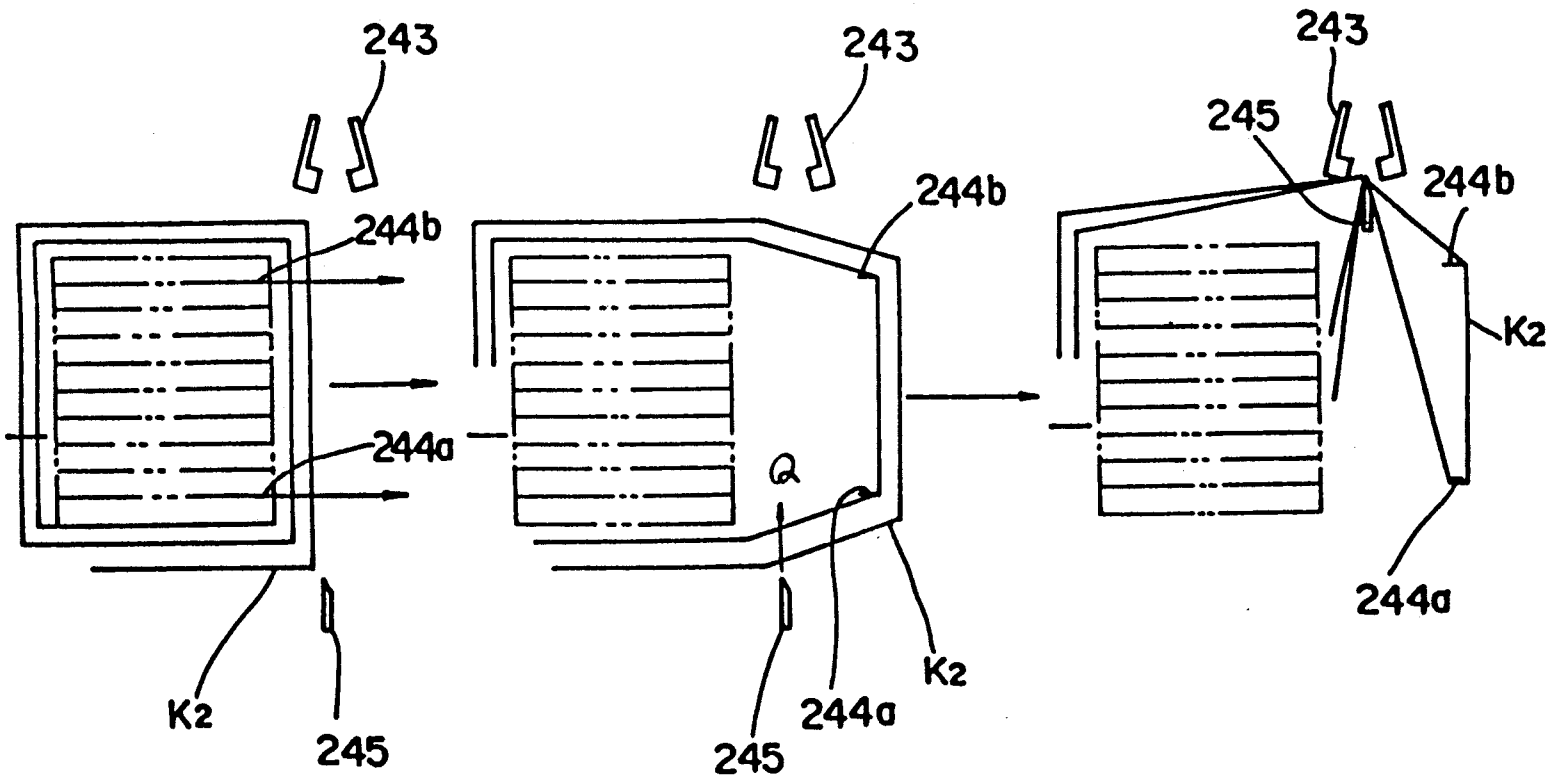
FIG. 4 is a diagram for explaining the process of removing a horizontal band in the apparatus of this invention.

The band removing section 206 comprises a band removing unit 240, a band catch 243, a band catch driving unit 242, and a band pushing-in unit 241. The unit 240 removes the band K2, which has been cut, from the bank notes C. The catch 243 is disposed near the corner of the bundle T in the region 213, and operated by the device 242 so as to sandwich the band K2. The band pushing-in unit 241 comprises a push-in member 245 that pushes the band K2 into the catch 243, as shown in FIG. 4. The band removing device 240 comprises a pair of band removing members 244*a* and 244*b*, and a band removing member driving device (not shown). The pair of band removing members 244*a* and 244*b* penetrate through the bank notes C so as to remove the band K2, as shown in FIG. 4. The band catch driving device 242 causes the catch 243 to open and close, and also transfers the catch 243 while rotating the same by 90 degrees.

Figure 3:
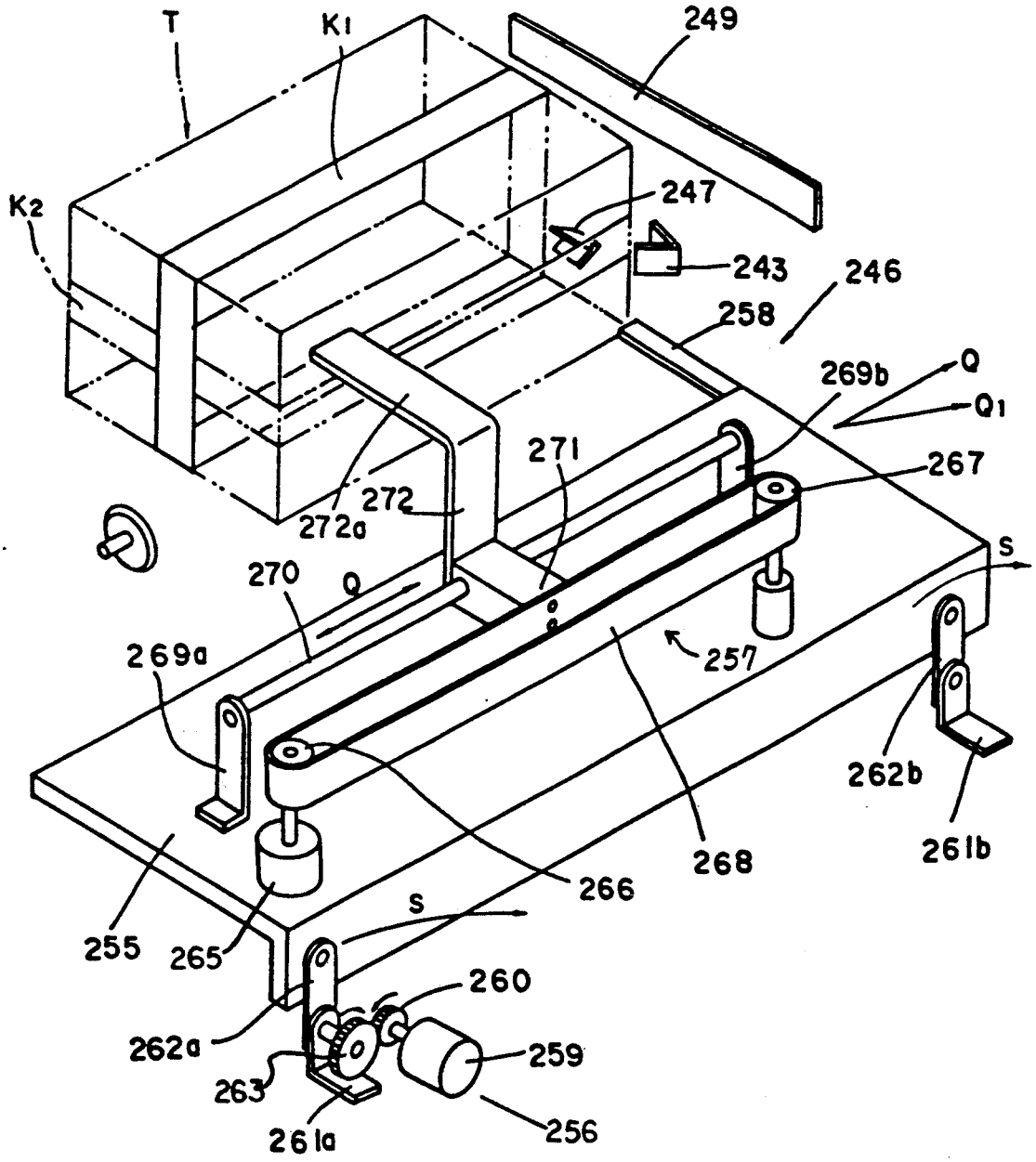
FIG. 3 is a perspective view illustrating a vertical band removing section in the apparatus of this invention.
Figure 5:
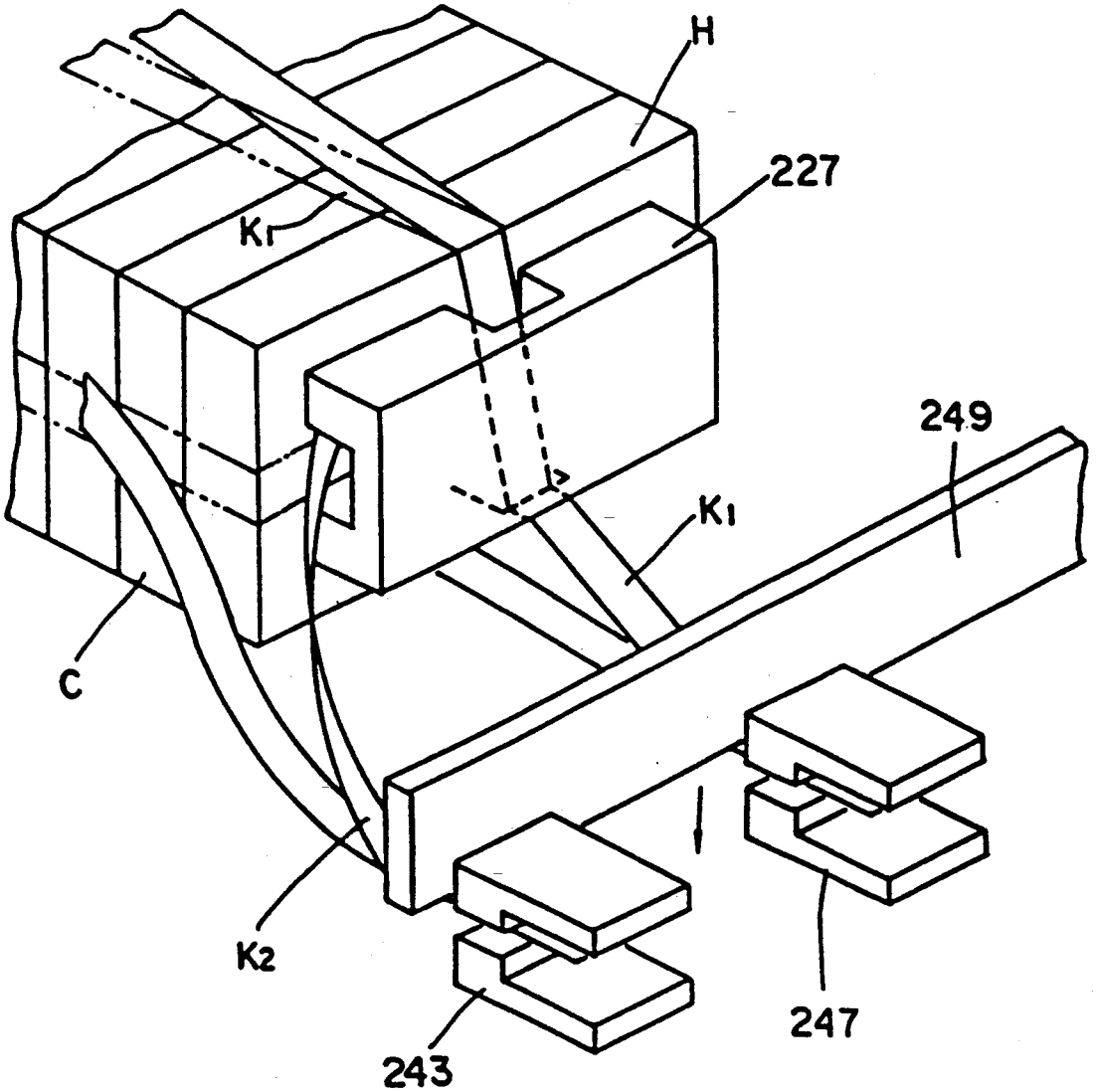
FIG. 5 is a diagram for explaining the operation of removing vertical and horizontal bands in the apparatus of this invention.

The band removing section 206 further comprises a vertical band removing section 246, a vertical band catch 247, a vertical band catch driving device 248, a band pulling-out device 249, a band separating section 250, and a removed band containing section 251. The section 246 is disposed under the cutaway hole 213*a* in the bundle processing region 213. The catch 247 is disposed near the lower corner of the bundle T in the region 213, and operated by the device 248 so as to sandwich the band K1. The device 249 pulls out both bands K2 and K1 which have been sandwiched by the catch 243 and the catch 247, respectively, as shown in FIG. 5. The section 250 is disposed near the corner of the bundle T, and serves to separate the band K2 from the bank notes C. The section 251 receives the separated bands and stores the same therein. The vertical band removing section 246 comprises a flat transfer table 255, a transfer table driving device 256, a vertical band removing device 257, a follower member 258. The device 256 transfers the table 255 in a direction of arrow Q, as shown in FIG. 3. The device 256 further transfers the table 255 in a direction of arrow Q1 (obliquely downward direction), as shown in FIG. 3. The device 257 is disposed on the table 255 (to be later described).

The follower member 258 projects from the table 255 toward the lower portion of the band separating section 250. The transfer table driving device 256 comprises an electric motor 259, a gear 260, a pair of fixed members 261*a* and 261*b*, a pair of movable members 262*a* and 262*b*, and a follower gear 263. The motor 259 is fixedly disposed at the lower portion of the table 255. The gear 260 is attached to the rotational shaft of the motor 259. Each one end of the movable members 262*a* and 262*b* is rotatably supported by the fixed members 261*a* and 261*b*, and each other end of the movable members 262*a* and 262*b* is rotatably attached to the table 255. The follower gear 263 is coupled to the movable member 262*a*, and engaged with the gear 260. The vertical band removing device 257 comprises an electric motor 265, a prime pulley 266, a follower pulley 267, a transfer belt 268, a pair of support members 269*a* and 269*b*, a transfer rail 270, a slidable block 271, and a vertical band removing member 272. The motor 265 is mounted on the table 255 such that the rotational shaft of the motor 265 perpendicularly projects from the table 255 in an upward direction, as shown in FIG. 3. The prime pulley 266 is attached to the rotational shaft of the motor 265.

The follower pulley 267 is disposed at a position separated from the prime pulley 266 by a prescribed distance in a direction of arrow Q. The transfer belt 268 is provided between the pulleys 266 and 267 with prescribed tension. The transfer rail 270 is supported by the pair of the support members 269*a* and 269*b* so as to be in parallel to the transfer belt 268. The slidable block 271 is slidably fitted to the transfer rail 270, and one side of the slidable block 271 is fixed to the transfer belt 268. The member 272 projects upward from the slidable block 271, and has a vertical band removing blade 272*a* at the upper portion of the member 272. The blade 272*a* penetrates between the bank notes C to remove the vertical band K1.

The horizontal band separating section 250 and the removed band containing section 251 will be described with reference to FIG. 6. The section 250 comprises a fixed support piece 281, a bearing 282, a shaft member 283, a moving member 284, and a vertical slide member 285. The piece 281 is fixed at a prescribed position. The bearing 282 is attached, having its axial direction faced to a vertical direction, to the fixed support piece 281. The shaft member 283 is supported by the bearing 282 so as to be freely movable in a vertical direction and to be rotatable together with the bearing 282 in a horizontal direction. The moving member 284 is attached to the upper end portion of the shaft member 283. The vertical slide member 285 comprises a vertical piece 285*a* elongated downward along the shaft member 283, and a horizontal piece 285*b* projected away from the shaft member 283. The vertical slide member 285 further comprises a bent piece 285*c* bent downward at its top end. The bent piece 285*c* has an elongated hole 286. Further, a pin-supporting piece 285*d* that supports a pin 287 projects from the horizontal piece 285*b*. The pin 287 penetrates between the horizontal band K2 and bank note C. The vertical slide piece 285*a* is slidably supported by a guide member 288 so as to slide only in a vertical direction.

A push-pull arm 290 is attached to the bottom end of the vertical slide piece 285*a* through a link 289. Further, the arm 290 has a link 291 which is engaged with an elongated hole 258*b* of a linkage member 258. The bearing 282 is attached to one end portion of a substantially U-shaped rotatable arm 292. This arm 292 can rotate round the shaft member 283. The other end portion 292*a* of the arm 292 is disposed at a position lower and outside of the bent piece 285*c*. A roller 293 is attached to the end portion 292*a*. A support member 294 is attached to the arm 292 so as to be disposed at a position between the vertical slide piece 285*a* and the bent piece 285*c*. One end portion 294*a* of the support member 294 is bent so as to be parallel to the bent piece 285*c*. A roller 295 is attached to the end portion 294*a*, and engaged with the elongated hole 286. A portion of the support member 294 is bent vertically upward so as to form a band-pressing member 296. The rotatable arm 292 is stopped by a stopper 297, as shown in FIG. 6. The stopper 297 comprises a shaft 298, a stopper piece 299 and a spring 300. The shaft 298 is rigidly fixed to a prescribed position. The stopper piece 299 is rotatably supported by the shaft 298. The stopper piece 299 has an inclined side 299*a*. The lower end of the stopper piece 299 is engaged with the rotatable arm 292. The upper end of the stopper piece 299 is always in contact with the vertical slide piece 285. Further, the stopper piece 299 is always energized by the spring 300 in a direction shown by the arrow located beside the spring 300, as shown in FIG. 6. The rotatable arm 292 is always energized by a spring 301 in the direction of the arrow shown near the spring 301 in FIG. 6. Specifically, one end of the spring 301 is attached to a position in the vicinity of the bearing 282. The other end of the spring 301 is attached to a spring hook pin 303 provided on a spring hook piece 302 attached to the fixed support piece 281.

Figure 7:
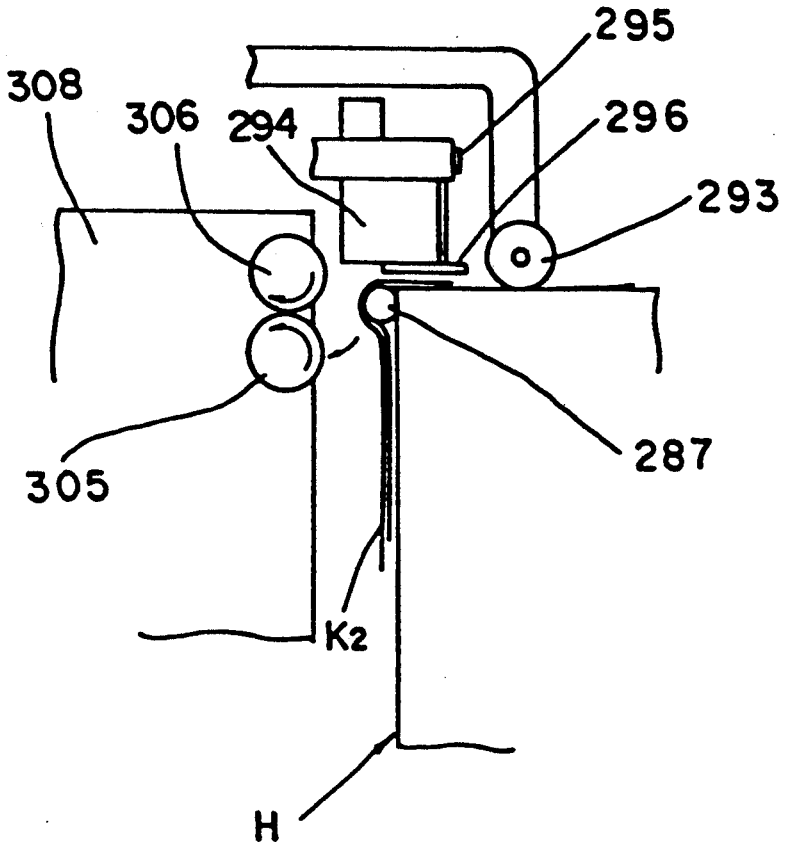
FIG. 7 is a diagram for explaining the operation of the section shown in FIG. 6.

The horizontal band containing section 251 comprises a pair of rollers 305 and 306, an electric motor 307 (not shown), and a horizontal band containing box 308. The pair of rollers 305 and 306 are disposed in a moving region of the pin 287 which penetrates between the horizontal band K2 and bank note C, as shown in FIG. 7. The roller 305 is driven by the electric motor 307.

Figure 8:
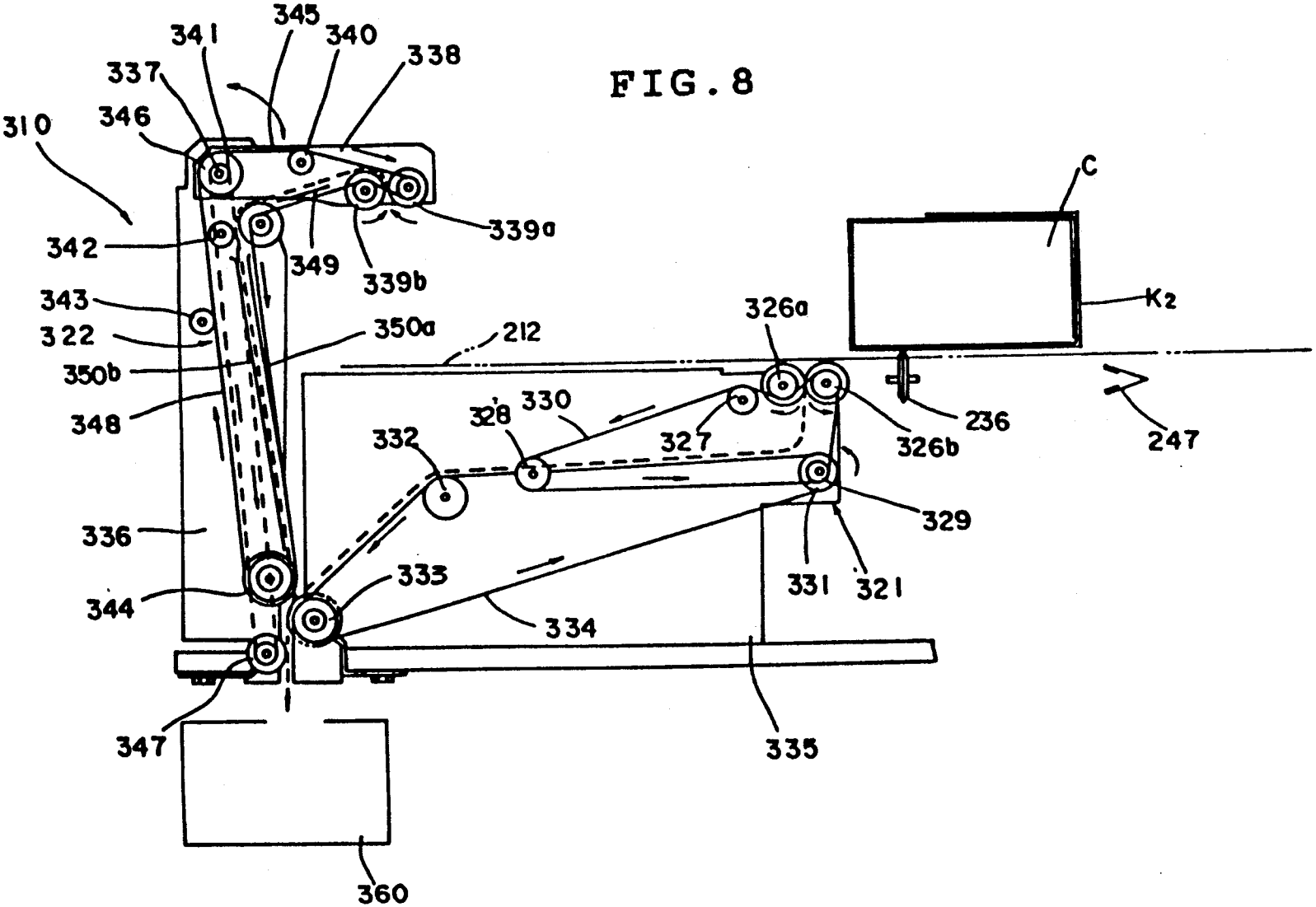
FIG. 8 is a schematic side view illustrating residual vertical band removing section in the apparatus of this invention.

FIG. 8 shows a residual vertical band removing section 310, which is provided between the direction changing region 212 and the bundle processing region 213. The residual vertical band removing section 310 comprises first and second band discharging units 321 and 322, and a discharged band container 360. The first band discharging unit 321 comprises a pair of pick-up rollers 326*a* and 326*b* made of material having a high friction coefficient, three driving rollers 327, 328 and 329, and a first pick-up belt 330. The driving rollers 327, 328 and 329 cooperatively drive the pick-up rollers 326*a* and 326*b* by use of the first pick-up belt 330.

The first band discharging unit 321 comprises a first discharge roller 331, a second discharge roller 332, a third discharge roller 333, and a first discharge belt 334. The first discharge roller 331 is disposed concentrically with the driving roller 329. The belt 334 is provided by way of the rollers 331 through 333 with tension. The rollers 326*a*, 326*b*, 327 through 329, and 331 through 333 are rotatably supported by a fixed frame 335, and rotated by electric motors (not shown) in directions of arrows, as shown in FIG. 8. The second band discharging unit 322 comprises a vertical fixed frame 336 and a rotatable frame 338. The frame 336 is disposed at a position adjacent to the fixed frame 335. The frame 338 is rotatably supported by a support shaft 337 provided on the top portion of the frame 336.

A pair of rollers 339*a* and 339*b* made of a material having a high friction coefficient, and rollers 340 and 341 are provided on the rotatable frame 338. Further, rollers 342 and 343, and a driving roller 344 are provided on the vertical fixed frame 336. Moreover, a second pick-up belt 345 is provided by way of rollers 339*a* and 339*b* and rollers 340 through 344 with tension. A fourth discharge roller 346 and a fifth discharge roller 347 are provided on the vertical fixed frame 336. Specifically, the roller 346 is disposed concentrically with the roller 341, and the roller 347 is disposed in the vicinity of the third discharge roller 333. Further, a second discharge belt 348 is provided by way of the rollers 346 and 347 with tension. The rollers 344 and 347 are rotated by electric motors (not shown) in directions of arrows, as shown in FIG. 8. Moreover, guide members 349, 350*a* and 350*b* are provided on the fixed frames 336 and 338, respectively.

A band scraping section 311 comprises a horizontal fixed member 370 and a brush-shaped scraping piece 371. The member 370 is disposed horizontally in the vicinity of the top surface of the sheaf H in the sheaf processing region 214. The brush-shaped scraping piece 371 projects downward from the horizontal fixed member 370, as shown in FIG. 2. A residual horizontal band removing section 312 comprises a pair of pick-up rollers 372 and 373, and a removed horizontal band containing box 374. The rollers 372 and 373 are disposed at a position opposing the sides of sheaves H transferred by the third transfer unit 221. The rollers 372 and 373 are rotated by an electric motor (not shown). In FIG. 2, reference numerals 375 through 377 designate guide members. A positioning member 378 is provided to position the sheaves to a prescribed position.

Figure 9:
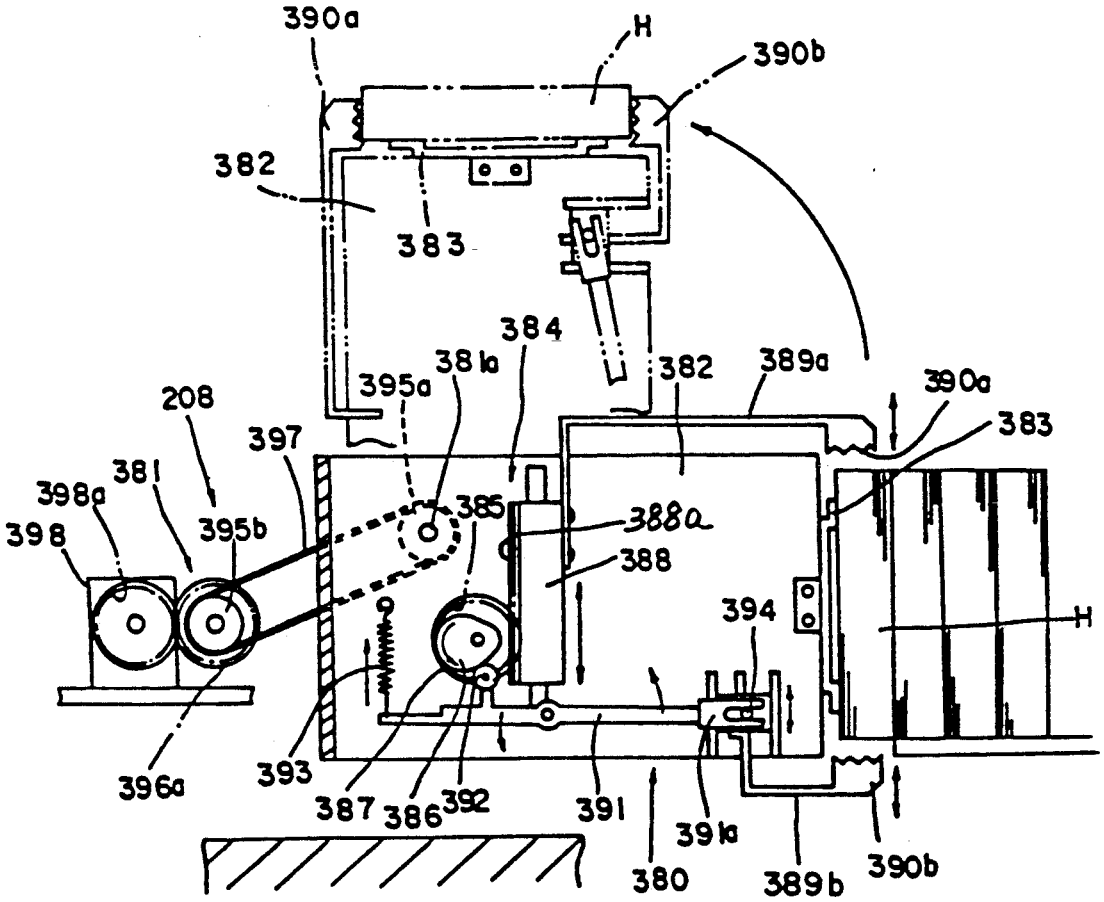
FIG. 9 is a schematic side view illustrating a sheaf extracting section in the apparatus of this invention.

The sheaf extracting section 208 comprises a sheaf-swiveling unit 380, and a driving unit 381 therefor. Specifically, the unit 380 is disposed at the end portion of the sheaf-processing region 215, and swiveled by the driving unit 381 by 90 degrees as shown in FIG. 9. The sheaf-receiver member 383, and a sheaf-sandwiching unit 384. The member 382 is rotatably supported by a supporting shaft 381*a*. The member 383 is attached to the opening side of the member 382, and the unit 384 is attached to the other side of the member 382, as shown in FIG. 9. The sheaf-sandwiching unit 384 comprises an electric motor 387, a first sliding member 388, a leaf spring 389*a*, upper and lower claws 390*a* and 390*b*, a lever 391, a cam 386, a cam follower 392, a spring 393, a second sliding member 394, and a leaf spring 389*b*. The motor 387 is fixed to the U-shaped swiveling member 382. A pinion 385 is attached to one end of the motor 387, and the cam 386 is attached to the other end of the motor 387. The motor 387 moves the upper and lower claws 390*a* and 390*b*. The pinion 385 is engaged with a rack 388*a* provided on the side of the sliding member 388. The leaf spring 389*a* is fixed to the member 388, and extends over the sheaf-receiver member 383. The upper claw 390*a* is attached to the projected end of the leaf spring 389*a*. The lever 391 is rotatably supported by a support shaft attached to the swiveling member 382. The cam follower 392 is in contact with the cam 386, and the lever 391 is energized by the spring 393 attached to one end of the lever 391 in a direction of arrow shown in FIG. 9. The second sliding member 394 is caused to slide by a link 391*a* provided at the other end of the lever 391.

The leaf spring 389*b* is attached to the member 394, and extends toward the under portion of the sheaf-receiver member 383. The lower claw 390*b* is attached to the leaf spring 389*b*. The swivel driving unit 381 comprises first and second pulleys 395*a* and 395*b*, first and second gears 396*a* and 398*a*, a brake 396, a belt 397, and an electric motor 398. The first pulley 395*a* is attached to the support shaft 381*a*. The brake 396 is disposed beside the swiveling member 382. The second pulley 395*b* and the first gear 396*a* are attached to the shaft of the brake 396. The belt 397 is provided by way of the first and second pulleys 395*a* and 395*b* with tension. The electric motor 398 is fixed at a prescribed position. The second gear 398*a* is attached to the motor 398. The second gear 398*a* is engaged with the first gear 396*a*, as shown in FIG. 9. The rotation of the motor 398 causes the swiveling member 382 to swivel by 90 degrees.

Figure 10:
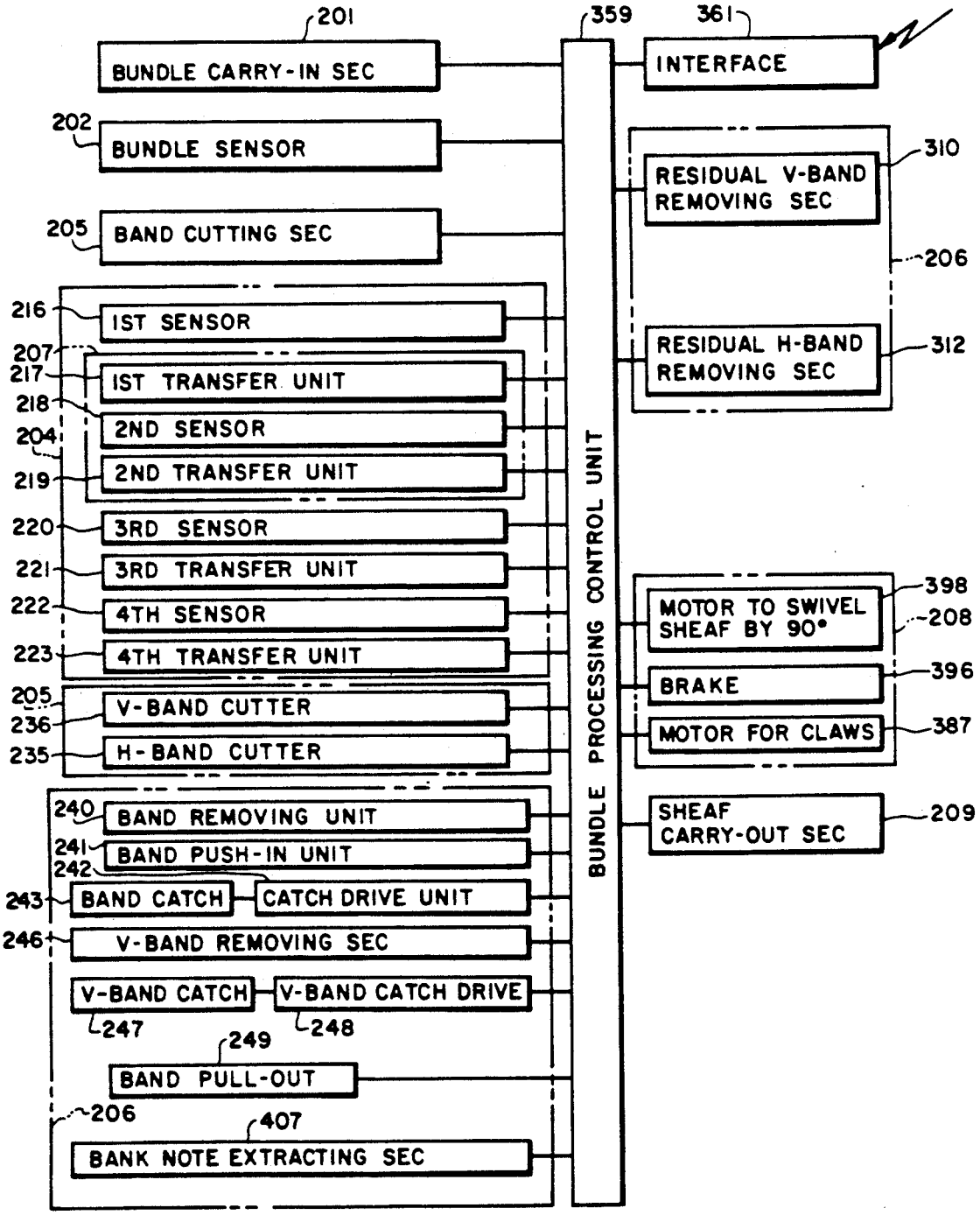
FIG. 10 is a block diagram illustrating a bundle processing control unit in the apparatus of this invention.

The control system of the bundle processing apparatus 200 will be described with reference to FIG. 10. The apparatus 200 comprises a bundle processing control unit 359 that receives the control signal sent from the control section of the inspection processing apparatus through an interface 361. The control unit 359 controls the bundle carrying-in section 201, the large band printer 203, the conveyance section 204, and the band cutting section 205. The control unit 359 further controls the band removing section 206, the sheaf storing section 207, the sheaf extracting section 208, and the sheaf carrying-out section 209.

Specifically, when a bundle T is carried-in by the bundle carrying-in section 201, the bundle sensor 202 detects the bundle T. The control unit 359 then causes the large band printer 203 to print discriminating information on the vertical band K1 of the bundle T. The bundle T is carried into the bundle receiving region 211 on the base 210. The first bundle sensor 216 then detects the bundle T, and sends a bundle-detecting signal to the control unit 359. Upon the reception of this signal, the control unit 359 causes the first sweeper 225 to move the bundle T in a direction of arrow P shown in FIG. 2. As a result, the bundle T makes contact with the moving wall 226. The second bundle sensor 218 detects the bundle T, and then sends a bundle-detecting signal to the control unit 359. The control unit 359 then causes the first and second transfers 228 and 229 to sandwich the bundle T, and to transfer the same to the bundle processing region 213 along a direction of arrow Q shown in FIG. 2. The band cutters 235 and 236 respectively cut the vertical band K1 and horizontal band K2 of the bundle T while it is transferred. The bundle T whose bands K1 and K2 have been cut reaches the end portion of the bundle processing region 213, and stops. Thereafter, the vertical and horizontal bands K1 and K2 are removed in the following manner.

Specifically, the third bundle sensor 220 detects the bundle T, and then sends a bundle-detecting signal to the control unit 359. Upon the reception of this signal, the control unit 359 causes the motors 266 of FIG. 3 to start the rotation. When the motor 266 rotates, the belt 268 is moved in a direction of arrow Q. Thus, the vertical band removing piece 272*a* penetrates between the bank notes C and the vertical bank K1. Further, the motor 259 is also caused to start the rotation at the same time as the motor 266 starts the rotation. Thus, the rotatable pieces 262*a* and 262*b* are rotated in a direction of arrow S shown in FIG. 3. As a result, the transfer table 255 and a vertical band removing piece 272*a* are moved obliquely downward so as to feed the removed vertical band K1 into the catch 247. Thereafter, the catch 247 is closed so as to sandwich the vertical band K1. The horizontal band K2 is removed in the following manner.

Specifically, a pair of band removing members 244*a* and 244*b* are moved so as to remove the horizontal band K2 from the bank notes C, as shown in FIG. 4. The band pushing-in member 245 is then moved so as to feed the horizontal band K2 into the catch 243, as shown in FIG. 4. Thereafter, the catch 243 is closed by the catch drive unit 248 so as to catch the removed horizontal band K2. Further, the drive unit 248 rotates the catch 243 by 90 degrees so as to be in parallel to the vertical catch 247. The band pulling-out member 249 is moved downward so as to depress the bands K1 and K2. As a result, most of the vertical and horizontal bands K1 and K2 are pulled out from the bundle T, as shown in FIG. 5.

Figure 6:
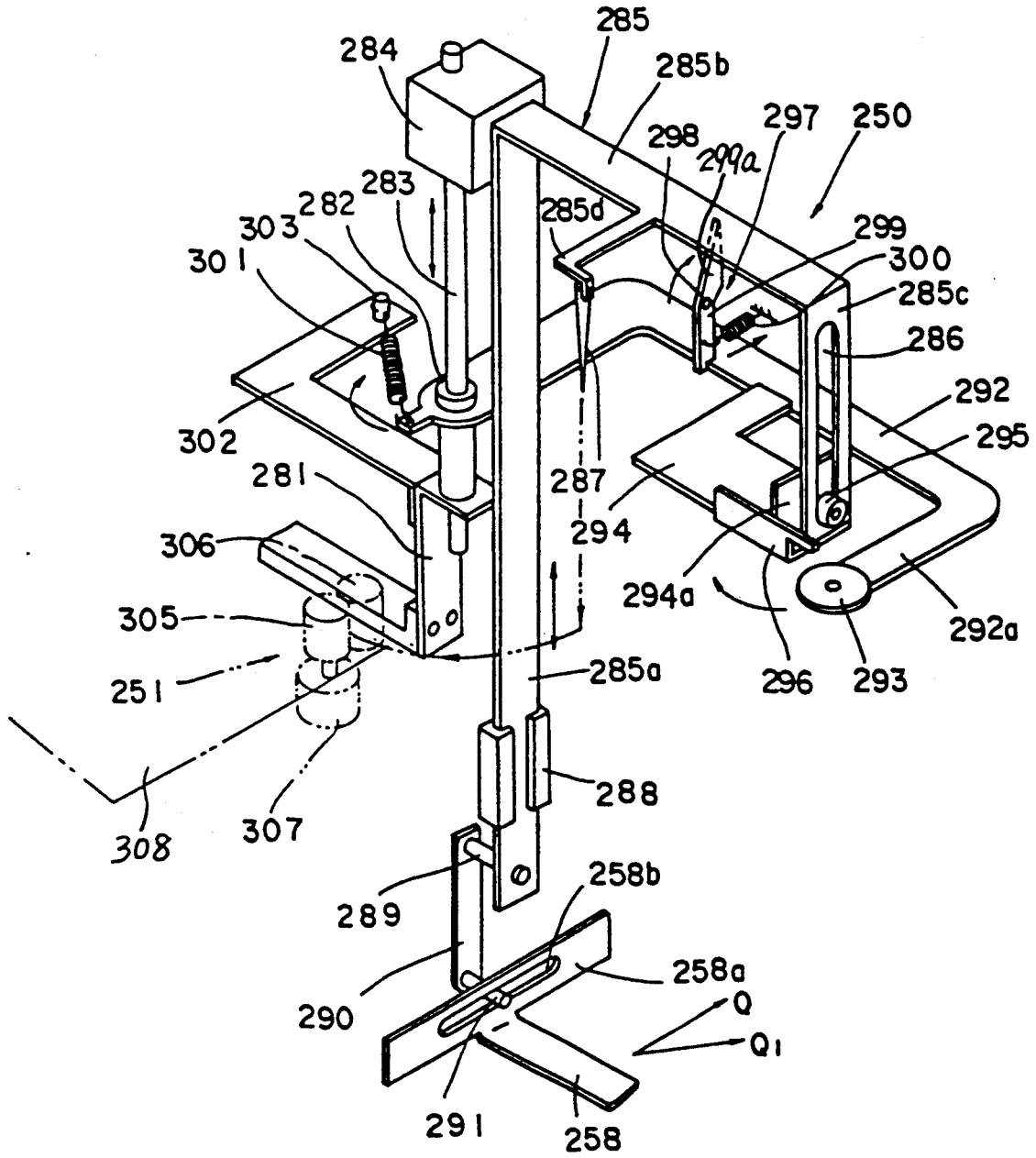
FIG. 6 is a perspective view illustrating a horizontal band removing section in the apparatus of this invention.

In FIG. 6, when the follower member 258 is moved in a direction of arrow Q1, the vertical piece 285*a* is pulled downward. Thus, the horizontal piece 285*b* depresses the stopper piece 299. As a result, the stopper piece 299 is rotated in a direction of the arrow shown in FIG. 6. This rotation allows the stopper piece 299 to separate from the rotatable arm 292. Consequently, the pin 287 is moved downward to penetrate between the horizontal band K2 and the bank notes C. Further, the pin 287 is rotated by the action of the rotatable arm 292 so as to move the band K2 to the pair of pick-up rollers 305 and 306. Thus, the band K2 is picked up by the rollers 305 and 306, and fed into the horizontal band containing box 308, as shown in FIG. 2.

As described above, most of the vertical and horizontal bands K1 and K2 are removed from the bundle T so as to produce a prescribed number of sheaves H. However, some portions of the bands K1 and K2 are inevitably left on the circumference of the bank notes C. Thus, such residual portions of the bands K1 and K2 are removed in the following manner. Specifically, the residual portions of the vertical band K1 are removed while the sheaves H are being returned to the transfer direction changing region 212 by use of the first and second transfers 228 and 229, as shown in FIG. 2.

More specifically, the residual portions of the vertical band K1 are picked up by the pick-up rollers 326*a* and 326*b*, and the pick-up rollers 339*a* and 339*b*. Further, the thus picked-up residual portions of the band K1 are discharged into the band storing box 360 by way of the prescribed routes, as shown in FIG. 8. The sheaves H which have been returned to the region 212 are sandwiched by the first sweeper 225 and the moving wall 226, and transferred in a direction of arrow P, as shown in FIG. 2. While a sheaf H is being extracted from the preceding sheaves H in the sheaf storing region 215, the movements of the first sweeper 225 and the moving wall 226 are temporarily stopped. Thus, the following sheaves H remain in the transfer direction changing region 212. The movements of the first sweeper 225 and the moving wall 226 will start moving immediately after the extraction of a sheaf in the region 215 ends. While the sheaves H are being transferred from the region 212 to the sheaf processing region 214, the remaining portions of the vertical band K1 are scraped from the bank notes C. This is performed by use of the scraper 371 provided over the position between the regions 212 and 214.

Further, the sheaves H are transferred to the sheaf storing regions 215 by use of the third transfer 230. While the sheaves H are being transferred to the region 215, the residual portions of the horizontal band K2 are removed by the pick-up rollers 372 and 373 as shown in FIG. 2. The sheaves H in the region 215 are aligned by the positioning member 378 shown in FIG. 2.

Further, the leading sheaf H of the sheaves H makes contact with the sheaf receiver member 383, as shown in FIG. 9. In FIG. 9, the motor 287 drives the pinion 385 and the cam 386 in the direction indicated by the arrow in accordance with a control signal produced from the bundle processing control unit 359. Thus, the pinion 385 causes the first sliding member 388 and the upper claw 390*a* to move downward so as to strongly push the leading sheaf H. Further, the cam 386 moves the lever 391, which, in turn, moves the lower claw 390*b* upward through the second sliding member 394 so as to strongly push the leading sheaf H. As a result, the leading sheaf H is sandwiched by the upper and lower claws 390*a* and 390*b*. Thereafter, the motor 398 rotates to swivel the U-shaped swiveling member 382 around the supporting shaft 381*a* by an angle of about 90 degrees. This movement is performed through the gears 398*a* and 396*a*, the second pulley 395*b*, the belt 397, and the first pulley 395*a*. As a result, the leading sheaf H can be extracted from the aligned sheaves H, as shown in FIG. 9. The thus extracted sheaf H is detected by the fourth sensor 222, and then the fourth transfer 231 transfers the sheaf H to the sheaf carrrying-out section 209.

The bundle conveyance processing apparatus 2 shown in FIG. 1 will be described with reference to FIGS. 11 through 17. The apparatus 2 comprises a bundle containing section 14, a carry-out bundle elevation transfer section 15, a carry-in bundle elevation transfer section 16, and a conveyance section 19. The section 14 includes an uninspected bundle storing unit 12 and an inspected bundle storing unit 13, both having a plurality of shelves 11. The section 15 carries out uninspected bundles from the unit 12, and the section 16 carries inspected bundles in the unit 13. The conveyance section 19 includes a carry-out conveyor 17 and a carry-in conveyor 18.

Figure 11:
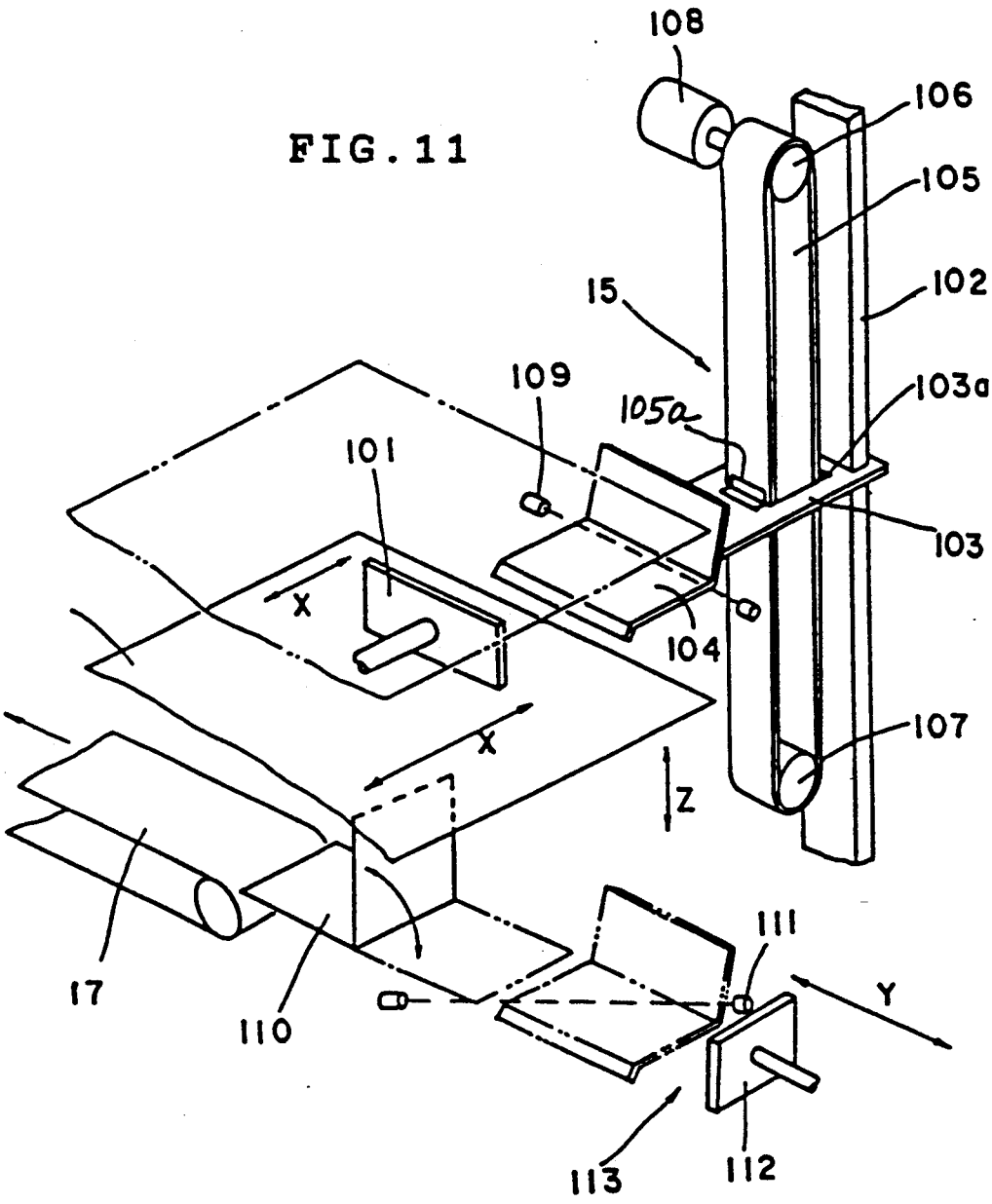
FIG. 11 is a schematic perspective view illustrating a carry-out bundle elevation transfer section in the apparatus of this invention.
Figure 12:
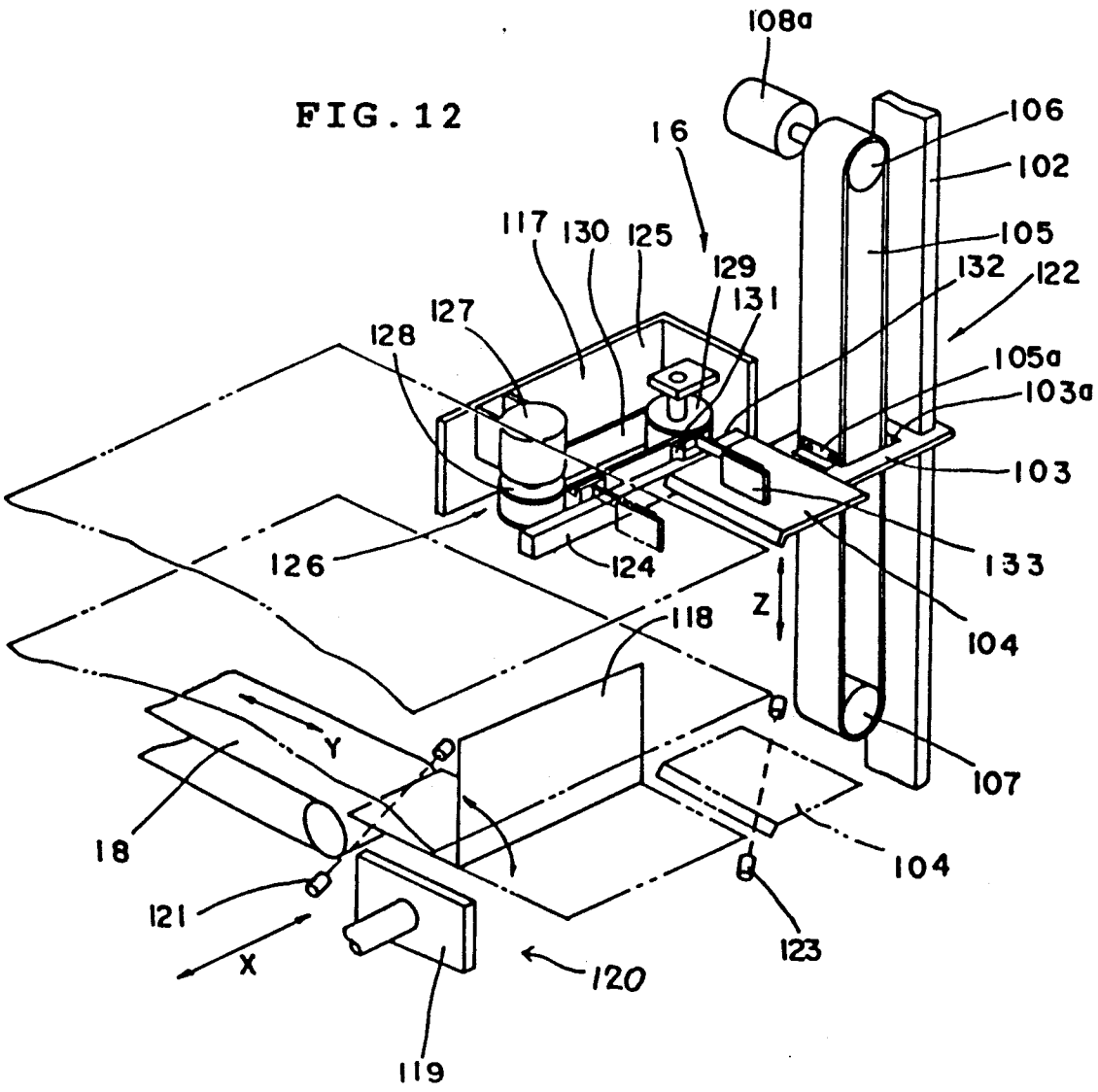
FIG. 12 is a schematic perspective view illustrating a carry-in bundle elevation transfer section in the apparatus of this invention.

Specifically, a bundle-pushing member 101 is provided on each shelf 11 of the unit 12 so as to push uninspected bundles toward the section 15 in a direction of arrow X, as shown in FIG. 11. In FIG. 11, the carry-out bundle elevation transfer section 15 comprises a first guide rail 102, a support member 103, a bundle-receiving member 104, a belt 105, and a coupling piece 105*a*. Further, the section 15 comprises a pair of pulleys 106 and 107, a first electric motor 108, a first sensor 109, a swiveling member 110, a second sensor 111, and a first pusher 112. The first guide rail 102 is vertically provided in the vicinity of the shelves 11. The support member 103 is fitted with the first guide rail 102 so as to be movable in a direction of arrow Z. The bundle-receiving member 104 is fixed at the end of the support member 103, as shown in FIG. 11. The belt 105 reciprocates penetrating through a rectangular hole 103*a* made in the support member 103. The support member 103 and the belt 105 are coupled by the coupling piece 105*a*. The pair of pulleys 106 and 107 are disposed at positions separated in a vertical direction, and the belt is provided therebetween with tension. The motor 108 drives the pulley 106 so as to move the belt 105 in the direction of arrow Z. The first sensor 109 includes a light-emitting element and a light-receiving element, and detects the presence of the bundle T extruded by the bundle-pushing member 101. The swiveling member 110 is disposed at a position to which the bundle-receiving member 104 descends deepest. Further, the member 110 is swiveled by an electric motor (not shown) by about 90 degrees so as to transfer the bundle T onto the end portion of the carry-out conveyor 17. The second sensor 111 having the same structure as the first sensor 109 detects the presence of the bundle T that has descended deepest. The first pusher 112 pushes the bundle T placed on the member 104 toward the swiveling member 110 in a direction of arrow Y, as shown in FIG. 11. The carry-in bundle elevation transfer section 16 differs from the section 15 in that a bundle-pushing unit 117 is provided, as shown in FIG. 12.

Specifically, the section 16 comprises a swiveling member 118, a bundle-receiving member 104, a second pusher 119, and a third sensor 121. The swiveling member 118 is provided in the vicinity of the end portion of a carry-in conveyor 18, and swiveled by an electric motor (not shown) by about 90 degrees. When the member 118 loaded with a bundle T is swiveled to a position surrounded by a dot-and-dash line, the second pusher 119 pushes the bundle T toward the bundle-receiving member 104 in a direction of arrow X shown in FIG. 12. The third sensor 121 serves to detect the presence of the bundle T on the member 104. The section 16 further comprises a bundle elevation unit 122 substantially the same as that of the section 15. The unit 122 includes an electric motor 108*a* that drives a pulley 106 so as to move a belt 105. The unit 122 also includes a fourth sensor 123 that detects whether or not the bundle T is positioned at a prescribed position corresponding to the shelf 11. The bundle-pushing unit 117 is attached to the bundle-receiving member 104, as shown in FIG. 12. The unit 117 comprises a guide rail 124, a fixed frame 125, and a pushing-in mechanism 126. The guide rail 124 is fixed to the side portion of the member 104, projecting in the direction of arrow X. The fixed frame 125 is fixed to the member 104. The pushing-in mechanism 126 pushes the bundle T into the shelf 11 following the guide rail 124.

Specifically, the pushing-in mechanism 126 comprises a third electric motor 127, a pair of pulleys 128 and 129, a belt 130, a slidable block 131, an arm 132, and a pushing-in member 133. The third motor 127 is mounted on the fixed frame 125. The pulley 128 is attached to the third motor 127, and the pulley 129 is rotatably supported by the fixed frame 125. The belt 130 is provided around the pulleys 128 and 129 with tension. The slidable block 131 is fixed to the belt 130, and fitted into the guide rail 124. The arm 132 projects from the slidable block 131 in a direction of arrow Y over the member 104. The pushing-in member 133 is attached to the arm 132.

Figure 13:
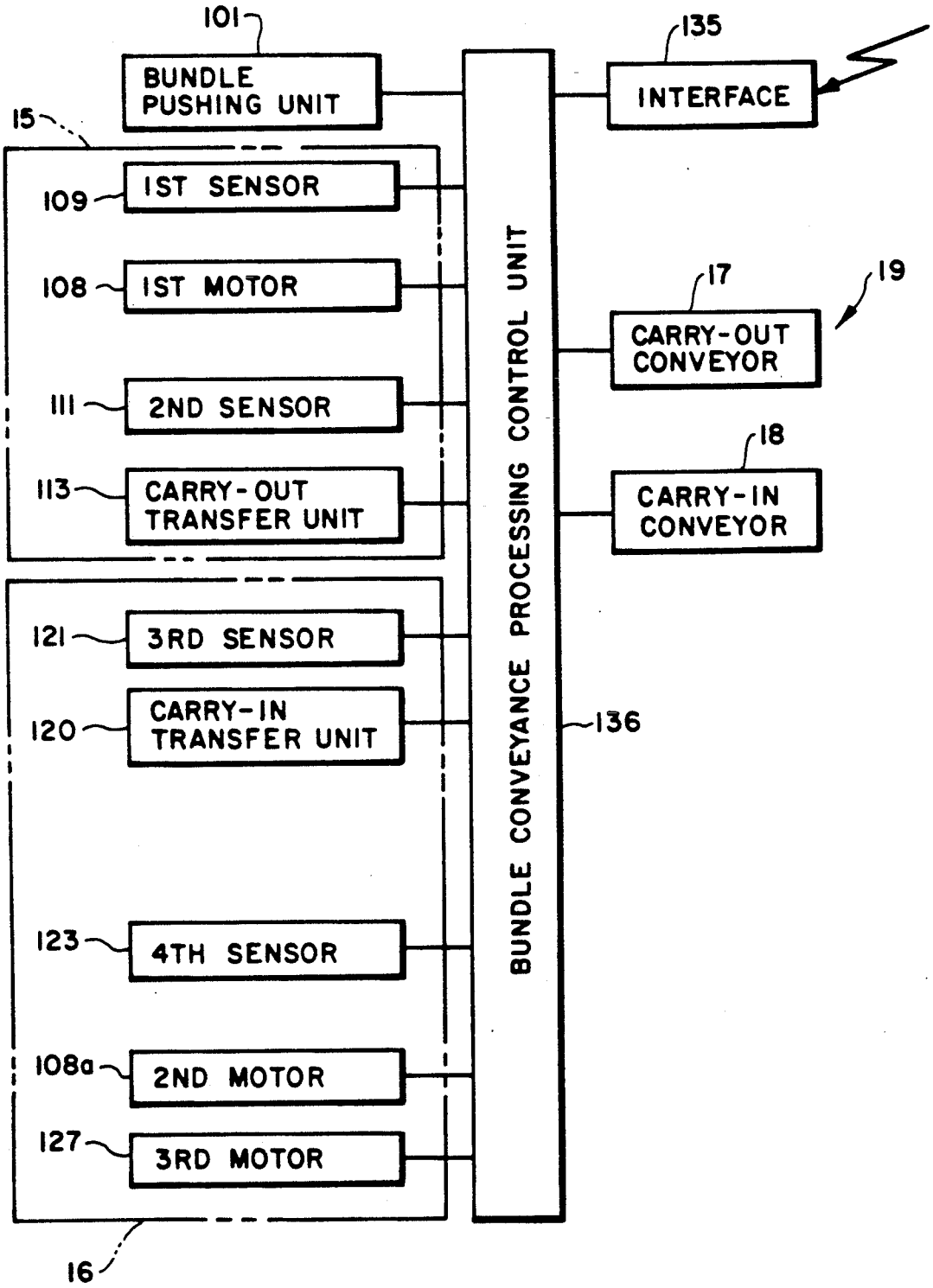
FIG. 13 is a block diagram illustrating a bundle transfer processing control unit in the apparatus of this invention.

The control system of the bundle conveyance processing apparatus 2 will be described with reference to FIG. 13. In FIG. 13, a bundle conveyance processing control unit 136 controls the overall operation of the apparatus 2 in accordance with a control signal sent from the central control apparatus 8 through an interface 135. Specifically, the control unit 136 controls the bundle-pushing unit 101, the carry-out bundle elevation transfer section 15, the carry-in bundle elevation transfer section 16, the carry-out conveyor 17 and the carry-in conveyor 18.

Figure 14:
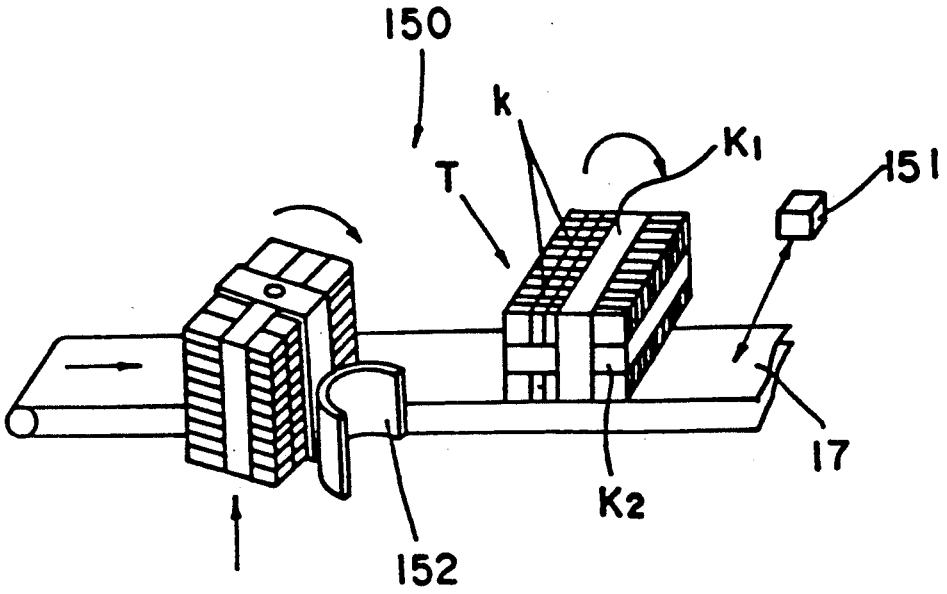
FIG. 14 is a schematic perspective view illustrating a ten-sheaf counting unit in the apparatus of this invention.
Figure 15:
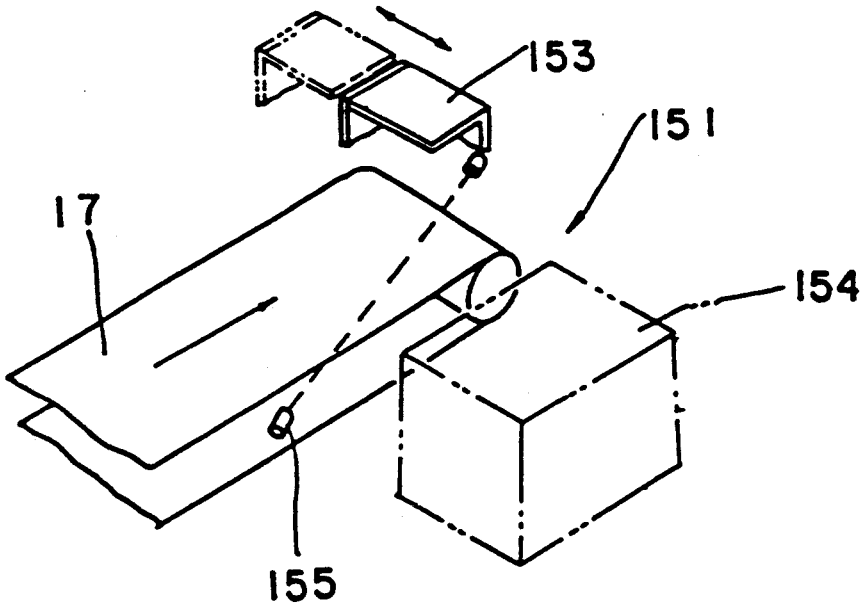
FIG. 15 is a schematic perspective view illustrating a bundle rejecting unit in the apparatus of this invention.

The bundle rejection unit 3 will be described with reference to FIGS. 14 and 15. The unit 3 comprises a ten-sheaf counting unit 150 and bundle-rejecting unit 151. The unit 150 is provided along the carry-out conveyor 17, as shown in FIG. 14. The unit 150 counts the number of sheaves H in the following manner. Specifically, a scanner 150*a* of the unit 150 applies a light beam to the bundle T being transferred as shown in FIG. 14. The light beam is scanned over the boundary lines of the small bands k. The amounts of reflected light vary each time the light beam crosses such boundary lines. Thus, the unit 150 can count the number of sheaves H by detecting the variation of the reflected light amount. Moreover, bundle-turing guide 152 is provided in the vicinity of the carry-out conveyor 17, as shown in FIG. 14. The guide 152 turns the bundle T so as to load the bundle T onto the conveyor 17 at a prescribed position.

The bundle-rejecting unit 151 comprises a bundle-rejecting arm 153, a rejected bundle storing box 154, and a bundle sensor 155. The arm 153 is actuated in accordance with a signal produced from the ten-sheaf counting unit 150. Assume that the unit 150 has recognized an abnormality in the number of sheaves H in the bundle T. The arm 153 would project over the conveyor 17 before the bundle T reaches a prescribed position on the conveyor 17. The front of arm 153 stops the movement of the bundle T, and the sidewall of arm 153 pushes the bundle T off the conveyor 17 into the rejected bundle storing box 154. The bundle sensor 155 detects the presence of the bundle T, and produces a signal to trigger the arm 153. However, when the unit 150 has recognized normalcy in the number of sheaves H in the bundle T, the arm 153 will not project. Thus, the bundle T can pass through without being stopped, and can reach a buffer conveyor 17A, which will be later described.

Figure 16:
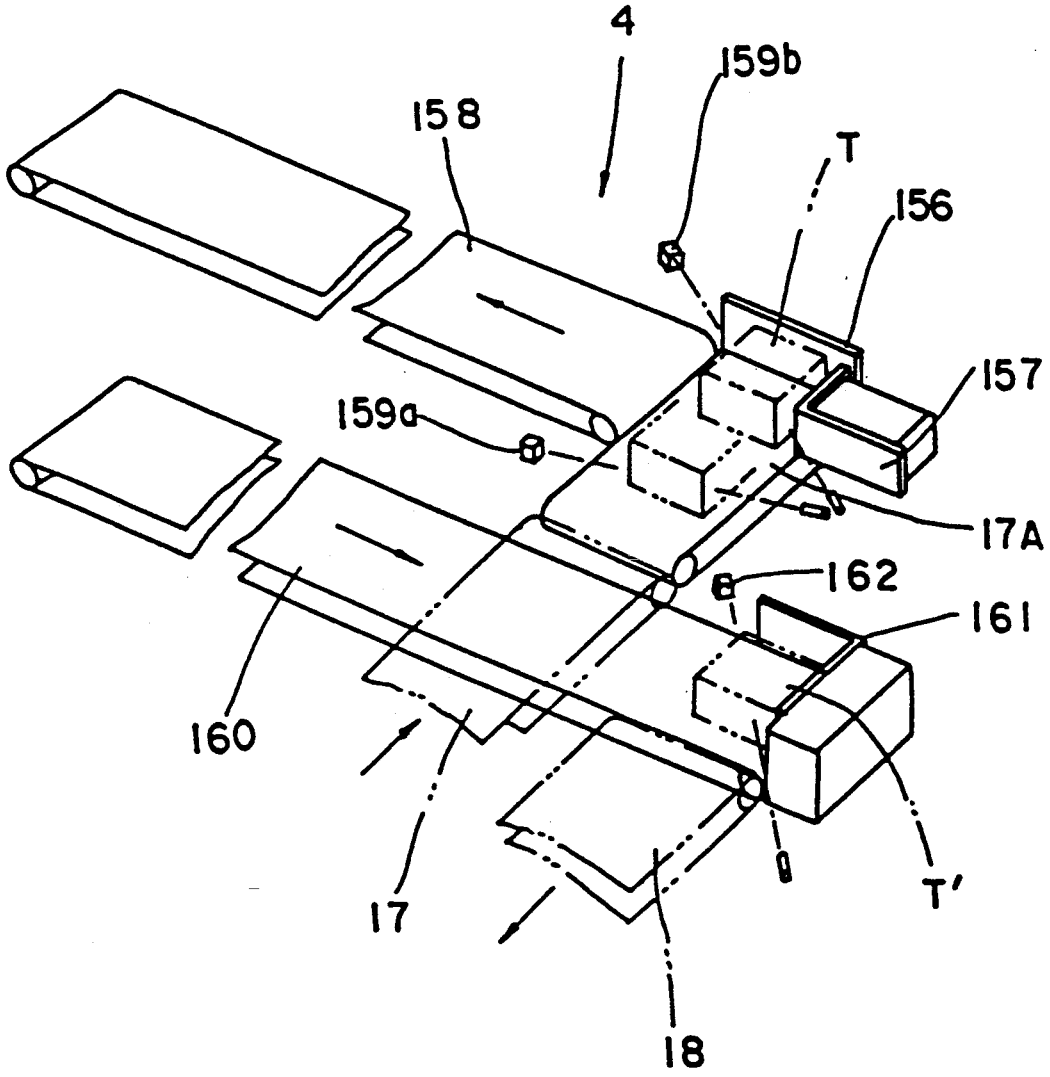
FIGS. 16 and 17 are a perspective view and a cross-sectional view respectively, illustrating a bundle transfer unit in the apparatus of this invention.
Figure 17:
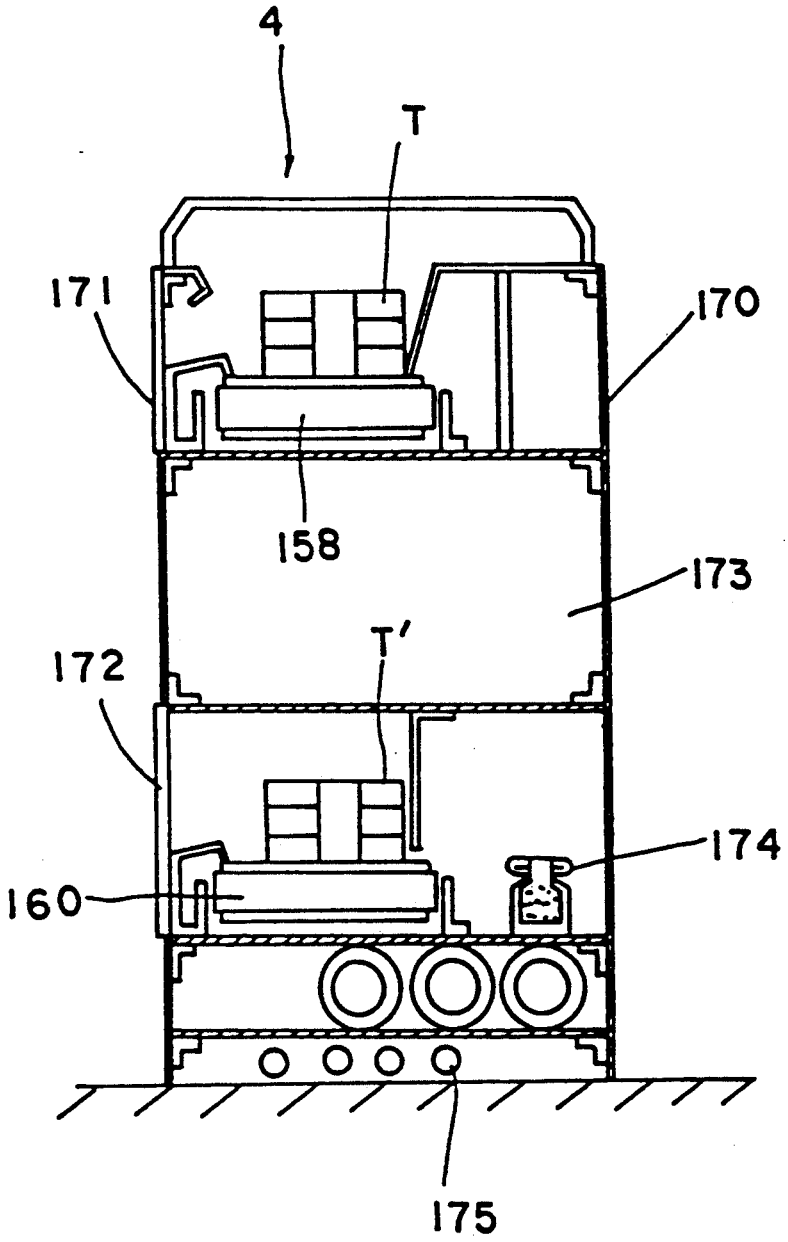

The bundle conveyance unit 4 will be described with reference to FIGS. 16 and 17. In FIG. 16, the buffer conveyor 17A receives the bundle T which has been transferred by the carry-out conveyor 17 of the bundle processing apparatus 2. The thus received bundle T is stopped by a bundle-stopping wall 156 provided in the vicinity of the end portion of buffer conveyor 17A. Two bundles T can be stored on the buffer conveyor 17A. Specifically, a second bundle T is stopped immediately after a first bundle T, being in contact with each other. In this embodiment, two bundles T are stored on the buffer conveyor 17A. However, the number of bundles T to be stored is not limited to this, i.e., any number of bundles T may be stored depending on the design of buffer conveyor 17A. As seen from FIG. 16, a bundle feeder 157 is actuated in accordance with a control signal sent from the central control apparatus 8.

Specifically, the bundle feeder 157 feeds one of the two bundles T onto the bundle-feeding conveyor 158. In this case, the second bundle T is stopped by the sidewall of the bundle feeder 157 while the first bundle is being fed onto the conveyor 158. Thus, the second bundle T can be moved toward the bundle-stopping wall 156 only after the bundle feeder 157 has returned to its original position. When the second bundle T is stopped by the bundle-stopping wall 156, the bundle feeder 157 is made ready to execute a subsequent operation. In FIG. 16, bundle sensors **159*a* and 159*b* detect the presence of the first and second bundles, respectively. The bundle-detecting signals produced from the bundle sensors 159*a* and 159*b* are sent to the central control apparatus 8. A bundle-receiving conveyor 160 is disposed under the conveyor 158, as shown in FIGS. 16 and 17. A bundle feeder 161 is provided in the vicinity of the end portion of the conveyor 160. The bundle feeder 161 receives the inspected bundle T', and feeds the same onto the carry-in conveyor 18 of the bundle conveyance processing apparatus 2. This is performed on the basis of a bundle detecting signal produced form a bundle sensor 162. In FIG. 17, a housing 170 incorporates the conveyors 158 and 160. Further, open/close covers 171 and 172 are provided on the side of the housing 170 so as to carry-in and carry-out bundles T and T'. A heat-discharging duct, which discharges heat generated from the bundle conveyance processing apparatus 2 and the inspection apparatus 6, is provided in the housing 170. Moreover, signal cables 174 and power cables 175, which are connected between the apparautus 2 and the apparatus 6, are installed in the housing 170**.

The operation of the bundle conveyance processing apparatus 2 will be described. Assume that the bundle-receiving member 104 is situated at the same level as that of a specific shelf 11, as shown in FIG. 11. The bundle-pushing member 101 then pushes the uninspected bundle T in the X direction so as to feed the same onto the bundle-receiving member 104. The first sensor 109 then detects the bundle T on the member 104, and sends a bundle-detecting signal to the bundle processing control unit 136. The motor 108 rotates in accordance with a control signal sent from the bundle processing control unit 136. Thus, the bundle T on the bundle-receiving member 104 fixed to the belt 105 is moved downward to the bottom portion shown by the dot-and-dash line, as shown in FIG. 11.

The above-described operation will be performed with respect to each shelf 11. The bundle T at the bottom portion is detected by the second sensor 111. As a result, the first pusher 112 pushes the bundle T in the Y direction so as to feed the same onto the swiveling member 110. The swiveling member 110 then swivels by about 90 degrees so as to transfer the bundle T onto the carry-out conveyor 17. Thereafter, the conveyor 17 transfer the bundle T in the Y direction, as shown in FIG. 11. The bundle T is then transferred to the pre-processing apparatus 5 through the bundle rejection unit 3 and the bundle conveyance unit 4. The pre-processing apparatus 5 then feeds the bank notes sheet by sheet into the inspection apparatus 6.

A detailed description of the inspection of the bank notes performed in the inspection apparatus 6 will be omitted, as it is conventional. The inspected bank notes are than bound by a small band K and large bands K1 and K2 so as to be the processed bundle T'. The bundle T' is transferred to the carry-in bundle elevation transfer section 16 by way of the bundle-receiving conveyor 160 and the carry-in conveyor 18, as shown in FIG. 12. Assume that the bundle receiving member 104 is situated at a position indicated by a dot-and-dash line, as shown in FIG. 12. When the carry-in conveyor 18 carries in the bundle T' onto the swiveling member 118, the third sensor 121 detects the bundle T', and sends a detecting signal to the bundle processing control unit 136. The member 118 then swivels by about 90 degrees so as to transfer the bundle T' to a position in front of the bundle-receiving member 104. The second pusher 119 then pushes the bundle T' in the X direction so as to feed the same onto the member 104. The bundle T' is detected by the fourth sensor 123. As a result, the second motor **108*a* rotates so as to move the bundle T' on the member 104 fixed to the belt 105 upward in the Z direction. Specifically, the second motor 108*a* moves the bundle T' on the member 104 up to the specific shelf 11, as shown in FIG. 12. This is performed in accordance with a control signal sent from the bundle processing control unit 136. Further, the third motor 127 rotates so as to move the pushing-in member 133 in the X direction. As a result, the bundle T' on the member 104 is pushed into the specific shelf 11. The above-described operation is performed sequentially with respect to a large number of the processed bundles T', which will be pushed into the respective shelves 11, as shown in FIG. 12**.

Figure 18:
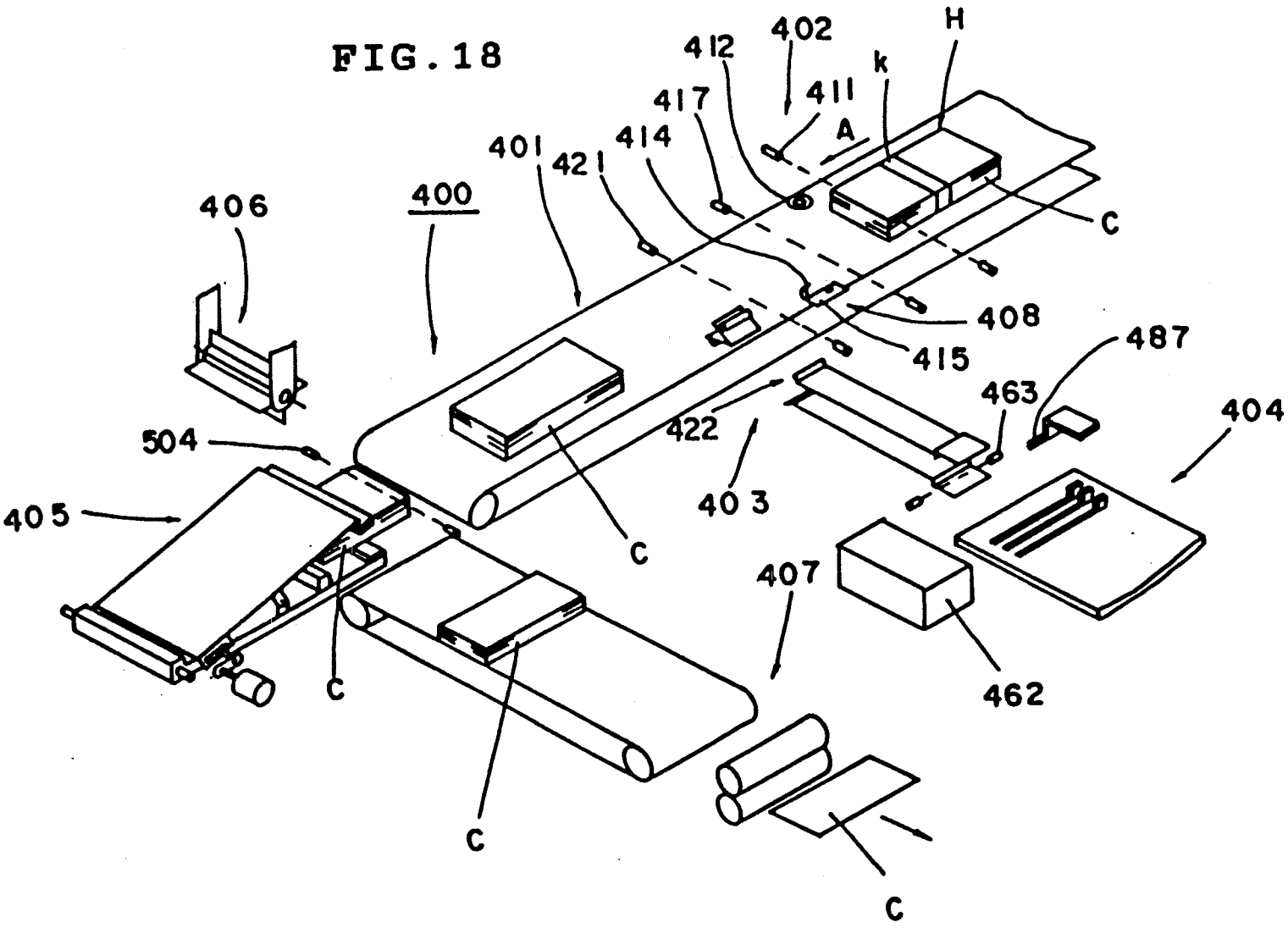
FIG. 18 is a schematic perspective view illustrating a sheaf processing section in the apparatus of this invention.
Figure 19:
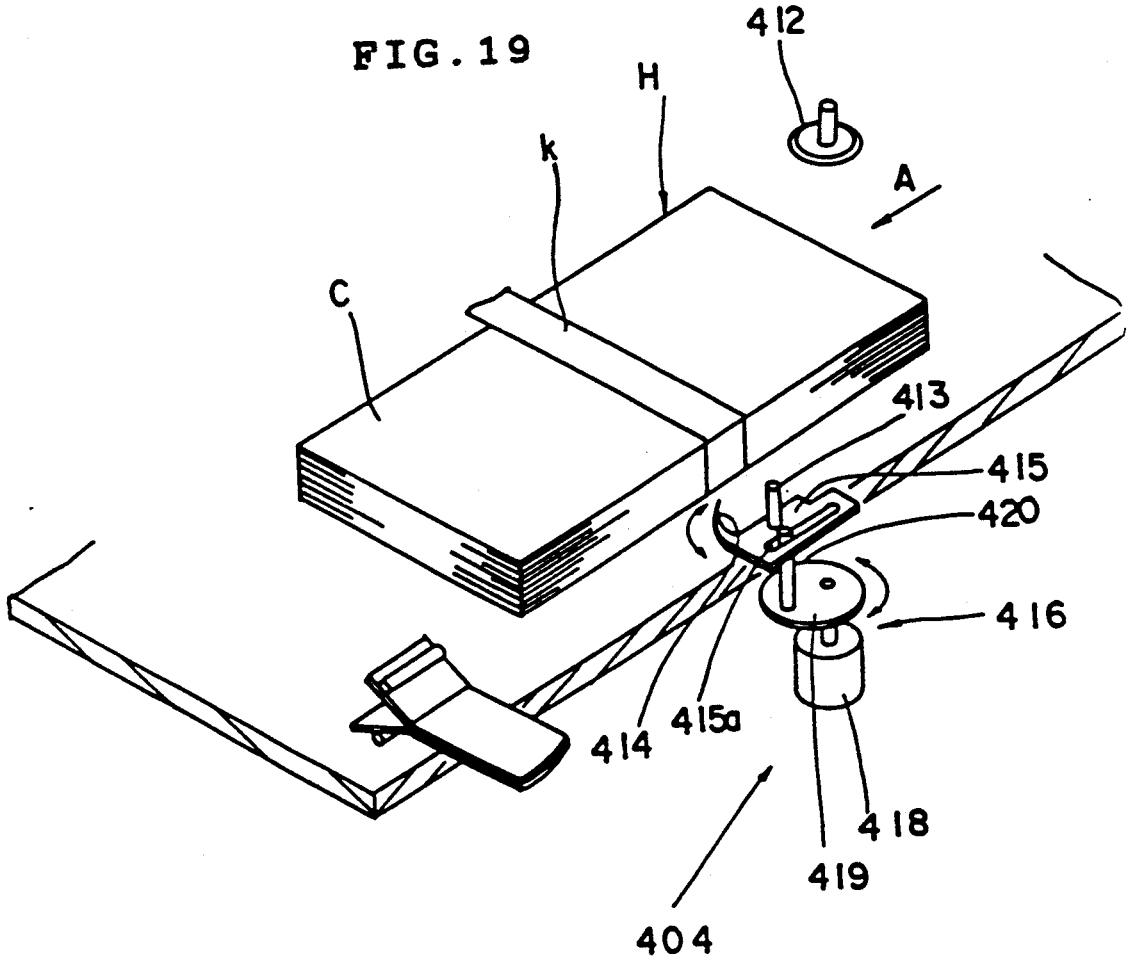
FIG. 19 is a schematic perspective view illustrating a band scraping section of the apparatus shown in FIG. 18.

The band-removing apparatus 400 of the pre-processing apparatus 5 will be described with reference to FIGS. 18 through 26. The band-receiving apparatus 400 comprises a sheaf transfer section 401 of a belt conveyor type, a band-cutting section 402, a band-scraping section 408, a band-removing section 403, and a band-storing section 404. The apparatus 400 further comprises a bank note-sandwiching/swiveling section 405, a residual band-scraping section 406, and a bank note-extracting section 407. The band-cutting section 402 cuts a small band K of the shelf H which has been transferred by the sheaf transfer section 401. The band-removing section 403 sandwiches the small band K cut by the section 402, and removes the same from the sheaf H. The band-storing section 404 collects the thus removed small band K, and stores the same therein. The bank note-sandwiching/swiveling section 405 sandwiches the prescribed number of bank notes C, and swivels the same upward to a prescribed position. The residual band-scraping section 406 scrapes off the residual bands left around or between the bank notes supported by the section 405. The bank note-extracting section 407 extracts the bank notes, whose residual bands have been scraped off, sheet by sheet, and feeds the same to the inspection apparatus 6. The band-cutting section 402 comprises a first sheaf sensor 411, and a small band cutter 412. The sensor 411 detects the sheaf H being transferred in the A direction on the sheaf transfer section 401. The cutter 412 is disposed in the vicinity of the sensor 411 so as to make contact with the sheaf H for cutting the small band K, as shown in FIG. 18. The band-scraping section 408 comprises a scraper member 415, a scraper-driving unit 416, and a second sheaf sensor 417. The member 415 is rotatably supported by a fixed shaft 413. The member 415 has a scraper 414 that penetrates between the bank note C and the small band K (see FIG. 19). The unit 416 drives the scraper member 415 so as to scrape the small bank K which has been cut by the cutter 412. The second sheaf sensor 417 detects the presence of the sheaf H on the sheaf transfer section 401. The scraper-driving unit 416 comprises an electric motor 418, an eccentric idler 419, and a pin 420. The motor 418 is disposed under the scraper member 415. The idler 419 is fixed to the shaft of the motor 418. The pin 420 projects from the idler 419, and is engaged with an elongated hole 415*a* made in the scraper member 415. The motor 418 repeats forward and reverse rotations in a prescribed manner. Thus, the scraper 414 penetrates between the small band K and the bank notes C so as to scrape the small band K from the bank notes C, as shown in FIG. 19. The band-removing section 403 comprises a third sensor 421 shown in FIG. 18, and a small band-removing section 422 shown in FIG. 20. The third sensor 421 detects the presence of the sheaf H on the sheaf transfer section 401. The small band-removing section 422 comprises a small band-sandwiching unit 423, and a small band-transferring unit 424. The small band-sandwiching unit 423 comprises a small band catch 426, and a catch driving unit 427. The small band catch 426 opens and closes using a shaft 425 as a fulcrum, and rollers 426*a* and 426*b*, as shown in FIG. 21. The catch driving unit 427 comprises a base 428, a rotational solenoid 429, a rotating board 430, a guide member 432, a pair of slidable blocks 433 and 434, and an upper lever 435. The catch driving unit 427 further comprises a first engaging pin 436*a*, a lower lever 437, a second engaging pin 436*b*, a pressing member 438, first and second contact pieces 439*a* and 439*b*, and an energizing member 440. The rotational solenoid 429 is mounted on the base 428. The rotating board 430 having a pair of symmetrical elongated holes 430*a* and 430*b* is attached to the rotating shaft of the rotational solenoid 429. The guide member 432 having a guide rail 431 is fixed to the base 428. The pair of slidable blocks 433 and 434 are provided in contact with the guide member 432 such that they can slide vertically along the guide rail 431. The upper lever 435 penetrates through the slidable block 433, and one end of the upper lever 435 is connected to the first contact piece 439*a*. The other end of the upper lever 435 has a first engaging pin 436*a* which is engaged with the elongated hole 430*a*. The lower lever 437 penetrates through the slidable block 434, and one end of the lower lever 437 is connected to the second contact piece 439*b*. The other end of the lower lever 437 has a second engaging pin 436*b* which is engaged with the elongated hole 430*b*. The first and second contact pieces 439*a* and 439*b* constitute the pressing member 438. The energizing member 440 is wound around the shaft of the rotational solenoid 429, and one end of the member 440 is touched using pressure to the first engaging pin 436*a*. The other end of the member 440 is touched using pressure to the second engaging pin 436*b*. Thus, the member 440 provides an energizing force against a rotational force generated by the rotational solenoid 430, as shown inn FIG. 21.

Figure 20:
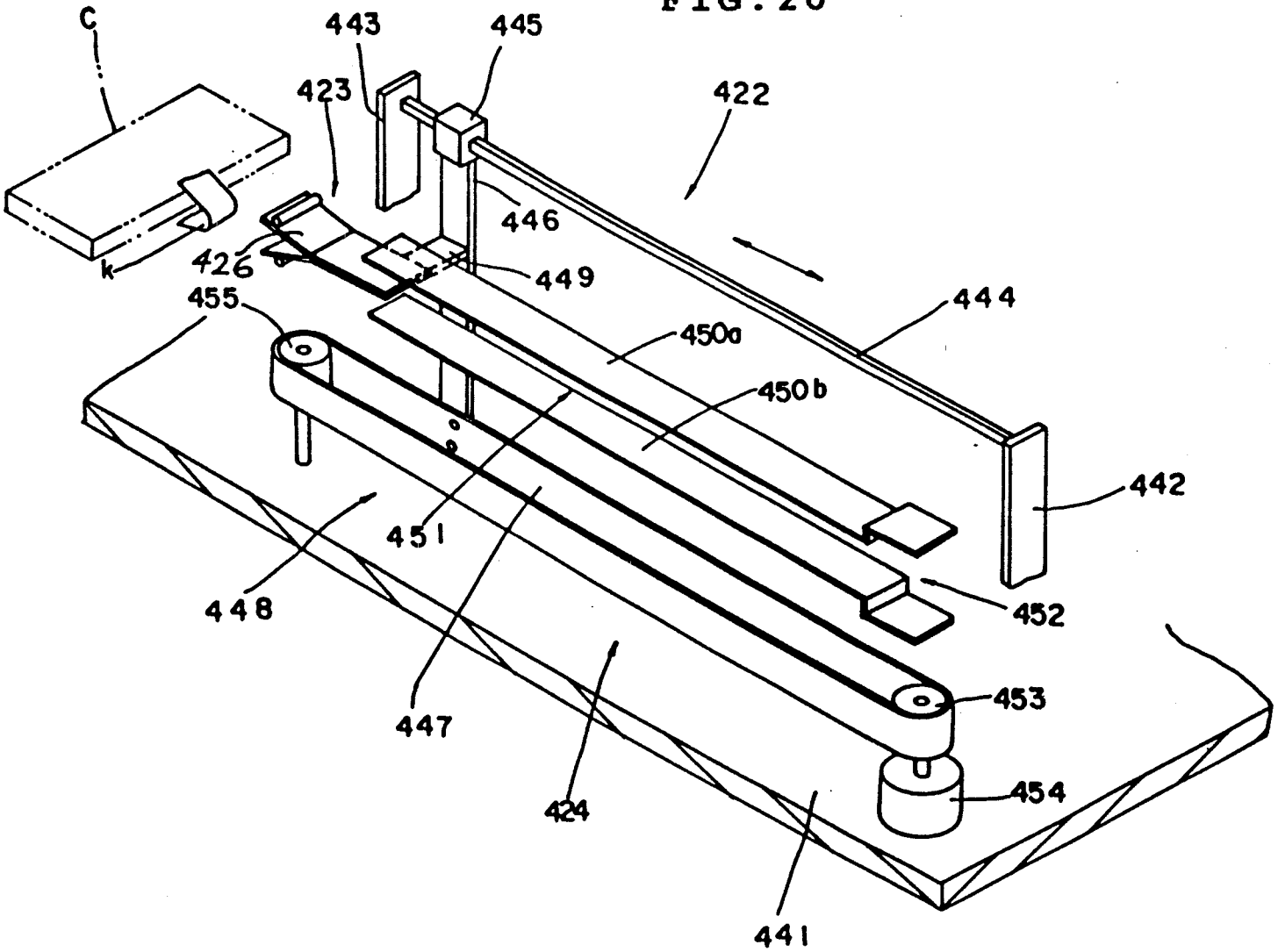
FIG. 20 is a schematic perspective view illustrating a band removing section of the apparatus shown in FIG. 18.
Figure 21:
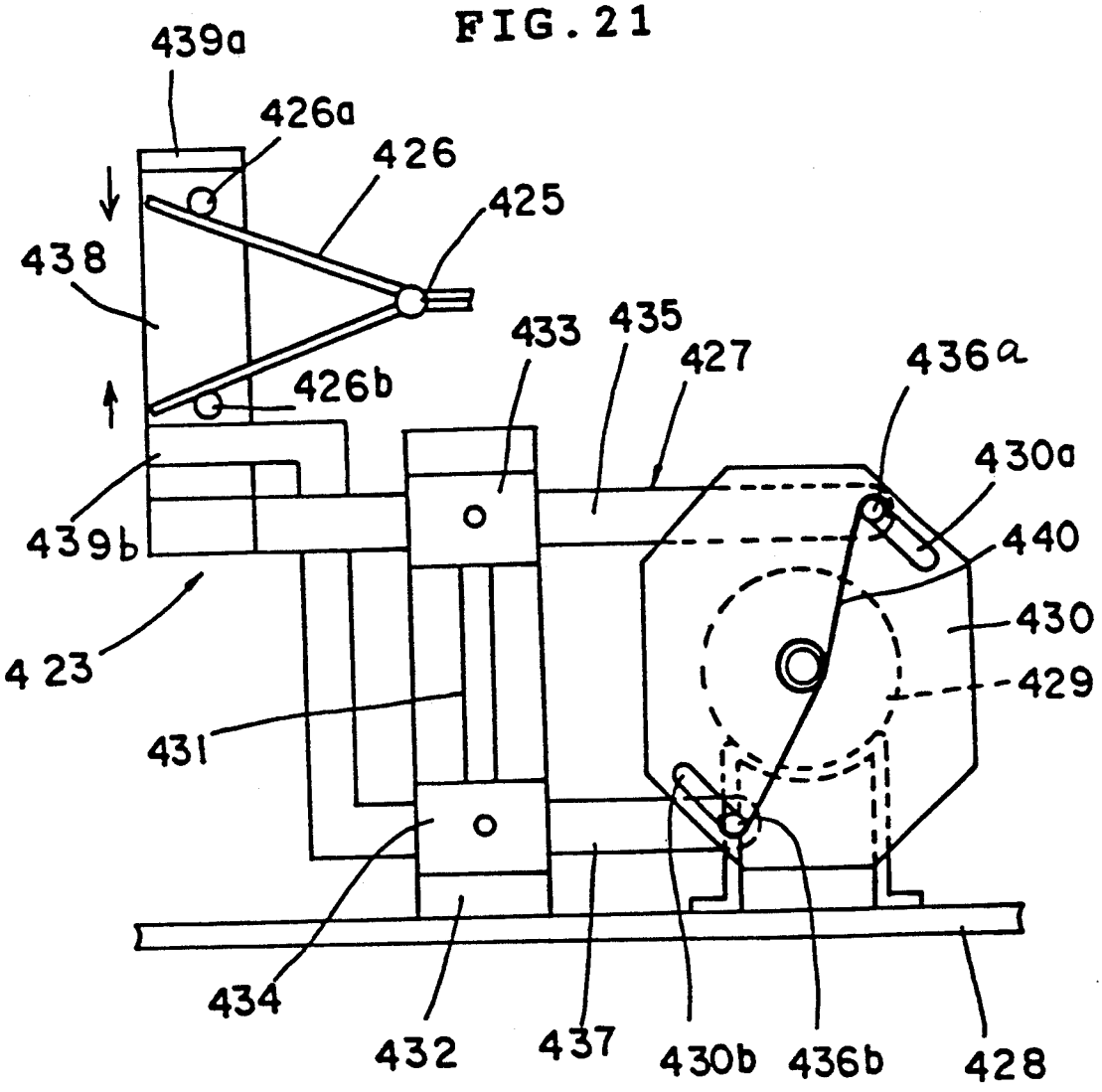
FIG. 21 is a schematic side view illustrating a small band catch and driving unit thereof in the apparatus shown in FIG. 18.

The small band-transferring unit 424 comprises a base board 441, a pair of supports 442 and 443, a guide rail 444, a slide member 445, a slide board 446, and a belt 447, as shown in FIG. 20. The unit 424 further comprises a small band-transferring mechanism 448, a connecting member 449, and a pair of catch guide boards 450*a* and 450*b*. The pair of supports 442 and 443 are fixed to the base board 441 a prescribed distance apart. The guide rail 444 is horizontally supported by the supports 442 and 443. The slide member 445 is slidably attached to the guide rail 444. The upper end of the slide board 446 is fixed to the slide member 445, and the lower end of the slide board 446 is fixed to the belt 447. The connecting member 449 connects the rear end of the small band catch 426 to substantially the center of the slide board 446. The catch guide boards 450*a* and 450*b* are disposed in parallel to the guide rail 444 so as to provide the moving region of the small band catch 426. The catch guide boards 450*a* and 450*b* leave a narrower space 451 and a broader space 452, as shown in FIG. 20. The narrower space 451 keeps the catch 426 closed while passing therethrough. The catch 426 then opens in the broader space 452. The small band-transferring mechanism 448 comprises a driver pulley 453, an electric motor 454 and a follower pulley 455. The driver pulley 453 is attached to the shaft of the motor 454. The belt 447 is provided between the pulleys 453 and 455 with prescribed tension, as shown in FIG. 20.

Figure 23:
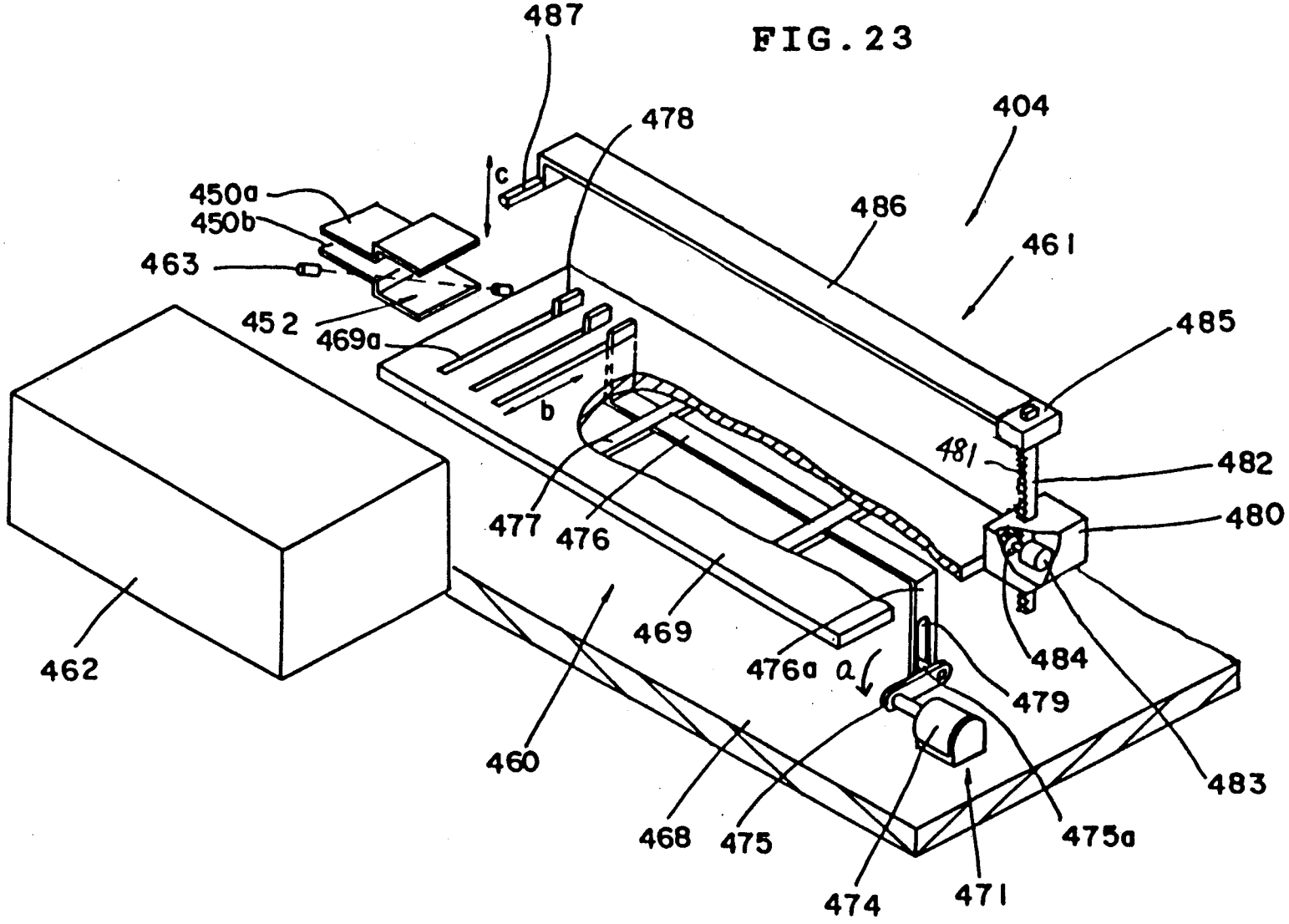
FIG. 23 is a schematic perspective view illustrating a small band storing section in the apparatus of this invention.

The small band-storing section 404 will be described with reference to FIG. 23. In FIG. 23, the small band receiving unit 460 comprises a small band sensor 463, a supporting board 468, a small band-placing board 469, and a small band-storing mechanism 471. The small band sensor 463 detects the presence of the small band k in the broader space 452 defined by the catch guide boards 450*a* and 450*b* shown in FIG. 20. The small band-placing board 469 is supported at a position parallel to the board 468. The small band-storing mechanism 471 moves a small band k placed on the board 469 to a small band-storing box 462. The small band storing mechanism 471 comprises an electric motor 474, a rotating arm 475, a slide lever 476, a lever guide 477, and three band-cramming members 478. The motor 474 is fixed to the board 468, and rotates the rotating arm 475, as shown in FIG. 23. The lever guide 477 is provided under the small band-placing board 469. The slide lever 476 is slidably supported by the lever guide 477. A vertical piece 476*a* having an elongated hole 479 projects downward from one end of the slide lever 476. A pin 475*a* projected from the rotating arm 475 is linked to the elongated hole 479 of the vertical piece 476*a*. The three band-cramming members 478 project upward from the other end of the slide lever 476. The members 478 penetrate through three elongated holes 469*a* made in the small band-placing board 469, as shown in FIG. 23. The small band-storing section 404 further comprises a vertically moving box 480, a vertical guide rail 482, an electric motor 483, a pinion 484, a fixed member 485, a support 486, and a band-depressing member 487. The vertically moving box 480 is fixed to the side of the small band-placing board 469. The vertical guide rail 482 is supported by the box 480. The guide rail 482 has a rack 481 which is engaged with the pinion 484. The motor 483 is fixed to the inside wall of the box 480, and the pinion 484 is fixed to the shaft of the motor 483. The member 485 is fixed to the upper end portion of the vertical guide rail 482. Further, one end of the support 486 is fixed to the member 485, and the other end of the support 486 extends to the portion over the elongated holes 469*a*. The band-depressing member 487 having a prism shape projects from the end portion of the support 486. When the pinion 484 is rotated by the motor 483, the vertical guide rail 482 is lowered. Thus, the band-depressing member 487 is lowered in a direction C as shown in FIG. 23, so as to depress the small band k.

Figure 24:
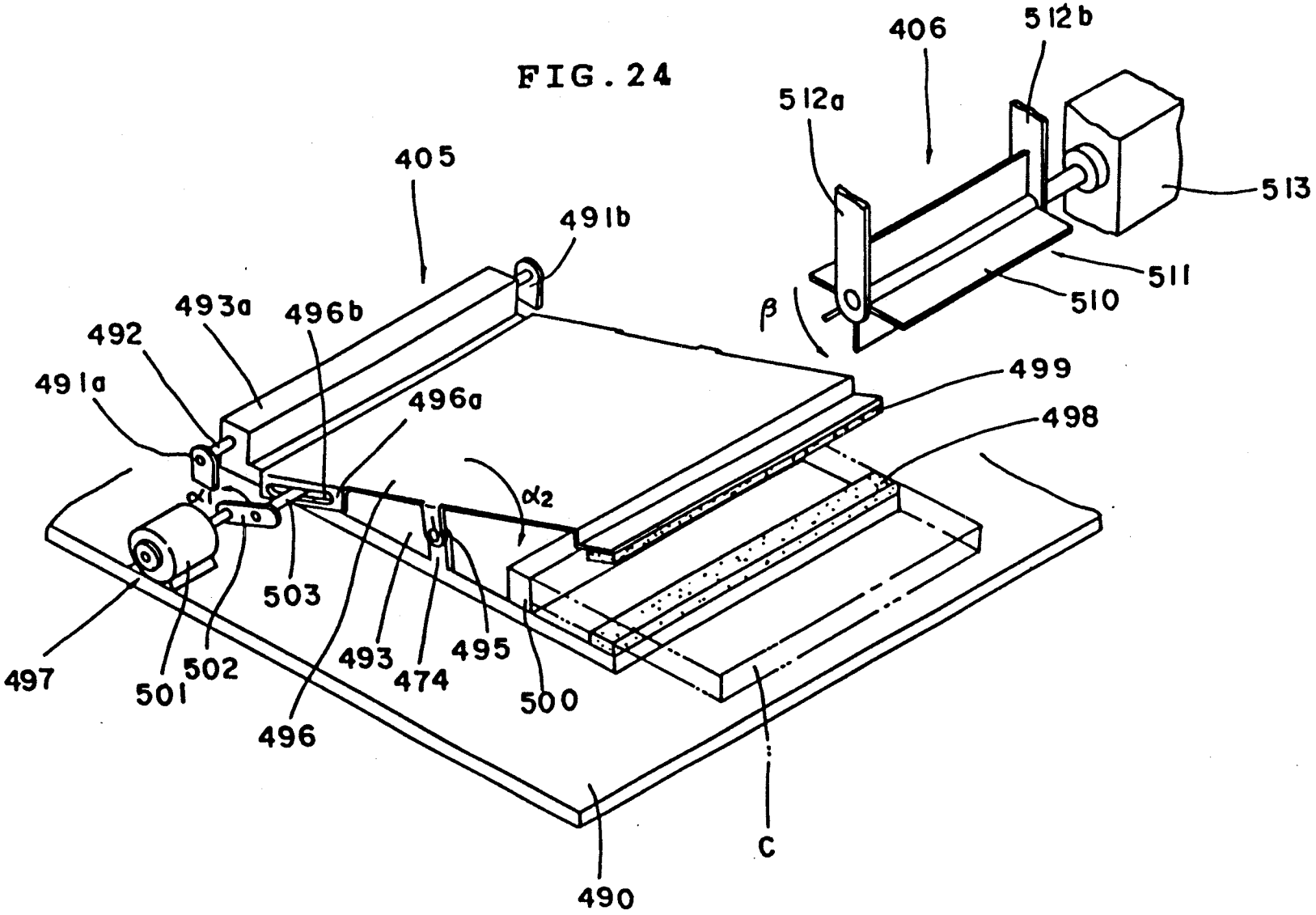
FIG. 24 is a schematic perspective view illustrating a bank note-sandwiching/swiveling section and a residual band-scraping section, both in the apparatus of this invention.
Figure 25A:
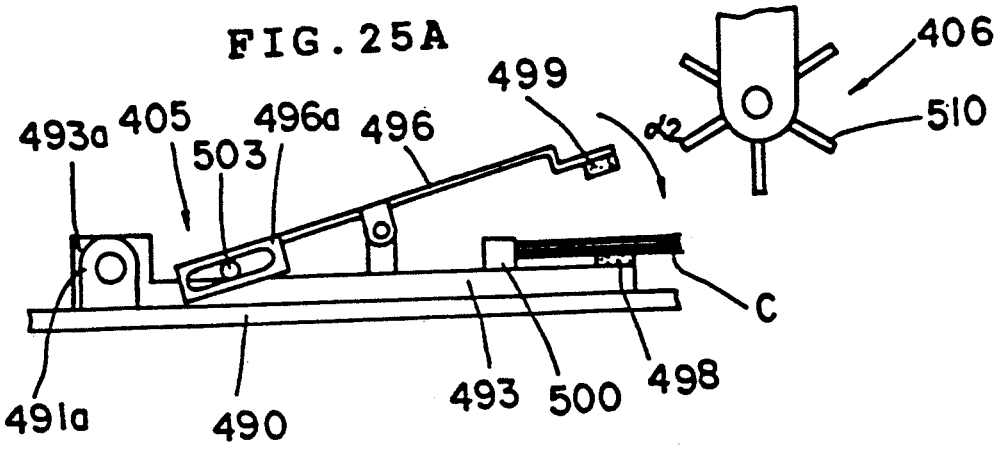
FIGS. 25A through 25C are diagrams for explaining the operation of the sections shown in FIG. 24.
Figure 25B:
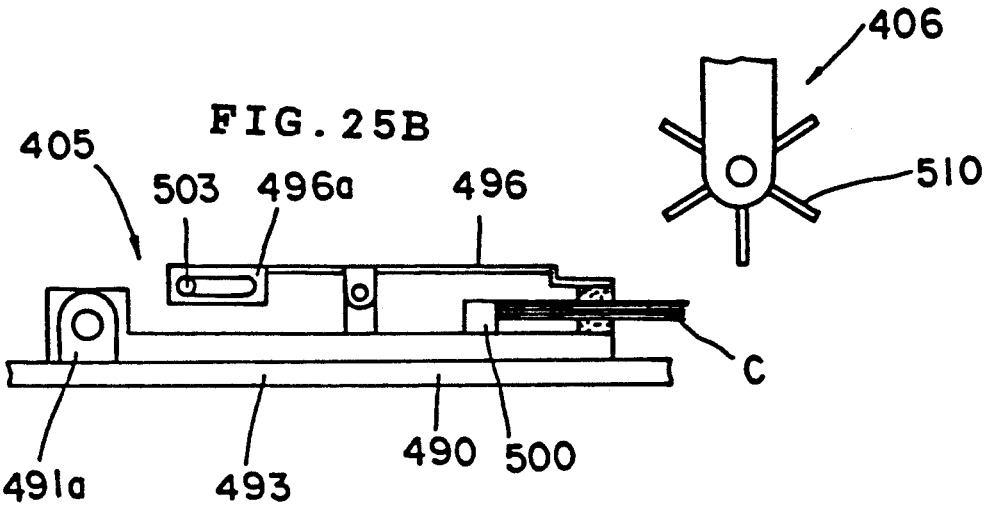
Figure 25C:
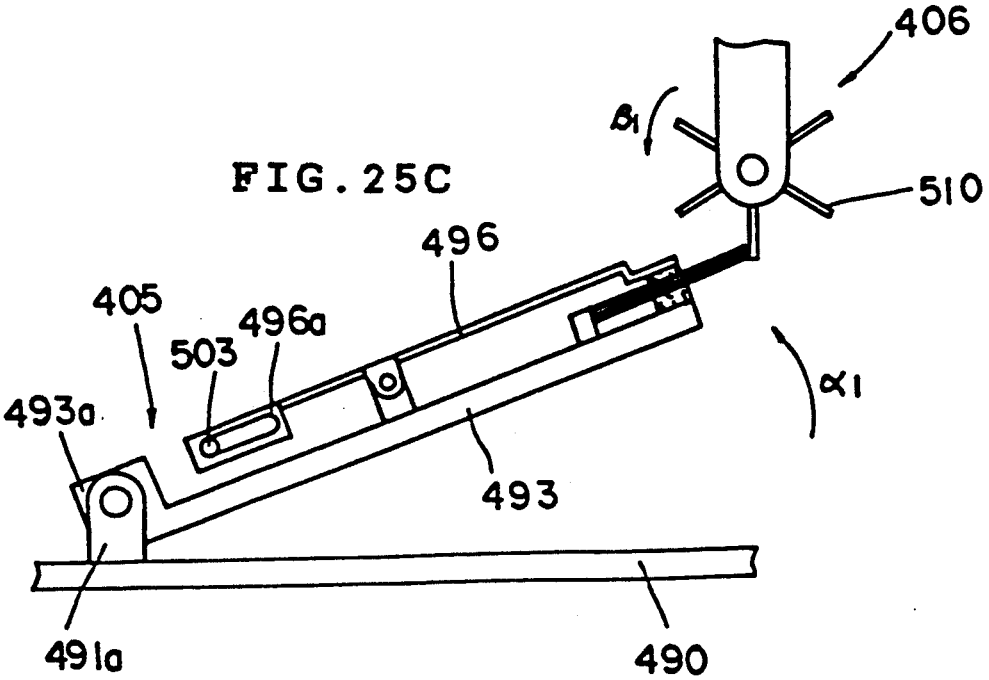

The bank note-sandwiching/swiveling section 405 and the residual band-scraping section 406 will be described with reference to FIG. 24. The section 405 is provided at a position adjacent to the end portion of the sheaf transfer section 401. The section 405 sandwiches the sheaf, whose small band has been substantially removed, and swivels the same up to a prescribed position. Specifically, the bank note-sandwiching/swiveling section 405 comprises a base board 490, a pair of supports 491*a* and 491*b*, a supporting shaft 492, a lower sandwiching member 493, a pair of supports 494*a* and 494*b*, and a pair of support pieces 495*a* and 495*b*. The section 405 further comprises an upper sandwiching member 496, and a driving section 497. The base board 490 is disposed under the end portion of the sheaf transfer section 401. The pair of supports 491*a* and 491*b* are provided on the board 490 with a prescribed interval. The shaft 492 is supported by the pair of supports 491*a* and 491*b*. A rear end portion 493*a* of the lower sandwiching member 493 is rotatably supported by the shaft 492, as shown in FIG. 24. The flat portion of the member 493 is placed on the board 490. The pair of supports 474*a* and 474*b* are provided on the member 493 at positions substantially in the center on both sides of the member 493. The pair of support pieces 495*a* and 495*b* are rotatably supported by the pair of supports 474*a* and 474*b*. The upper sandwiching member 496 is formed in substantially the same shape. The driving section 497 moves the upper sandwiching member 496 toward the lower sandwiching member 493 such that both the forefronts thereof close. The section 497 also swivels the members 493 and 496 while they are being closed, up to a prescribed position, as shown in FIG. 25C.

Specifically, in FIG. 24, front pieces 498 and 499 of the lower and upper sandwiching members 493 and 496 are made of a material having a high friction coefficient. A band note-stopper 500 is provided on the member 493 at a position between the forefront thereof and the support 494*a* in a direction parallel to the shaft 492, as shown in FIG. 24. The driving section 497 comprises an electric motor 501, an arm 502 and an engaging pin 503. The motor 501 is disposed on the base board 490, and one end of the arm 502 is attached to the shaft of the motor 501. The pin 503 projects from the other end of the arm 502 toward the upper sandwiching member 496. The pin 503 is engaged with an elongated hole 496*b* made in a bent piece 496*a* provided on the side of the member 496, as shown in FIG. 24. The bank note-sandwiching/swivel section 405 further comprises a sensor 504 that detects the presence of bank notes between the upper and lower sandwiching members 496 and 493. The residual band-scraping section 406 comprises a rotating member 511, a pair of supports 512*a* and 512*b*, and an electric motor 513. The rotating member 511 is provided at a position to which the bank notes sandwiched by the members 496 and 493 are swiveled. The rotating member 511 has plural scrapers (e.g., six rubber scrapers), and is rotatably supported by the pair of supports 512*a* and 512*b*. The motor 513 rotates the rotating member 511 in a direction of arrow $\beta$, as shown in FIG. 25*c*.

Figure 26:
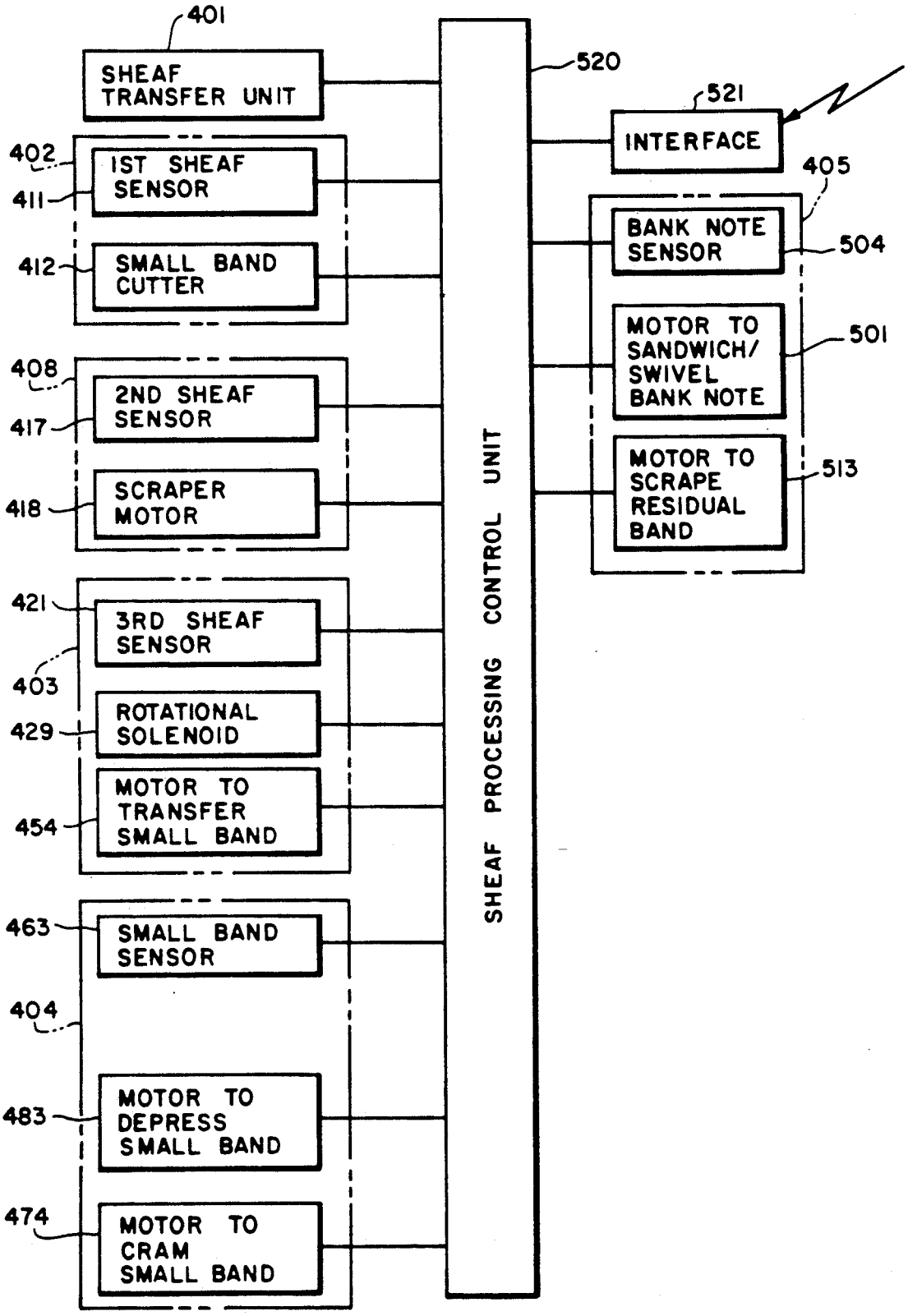
FIG. 26 is a block diagram illustrating a sheaf processing control unit in the apparatus of this invention.

The control system of the small band removing apparatus 400 will be described with reference to FIG. 26. The apparatus 400 comprises a sheaf-processing control unit 520. The unit 520 receives a control signal through an interface 521, which is sent from the inspection apparatus 6. The unit 520 controls the operations of the respective sections of the apparatus 400 in accordance with the thus received control signal. Specifically, the sheaf transfer section 401, the first sheaf sensor 411 and the small band cutter 412 of the band-cutting section 402, and the second sheaf sensor 417 and the scraper motor 418 of the band-scraping section 408 are respectively connected to the control unit 520. Further, the third sheaf sensor 421, the rotational solenoid 429 and the small band transfer motor 454 of the band-removing section 403, and the small band sensor 463, the horizontal transfer motor 472, the vertical transfer motor 483 and the small band storing motor 474 of the small band storing processing section 404 are respectively connected to the sheaf-processing control unit 520. Moreover, the bank note sensor 504 and the motor 501 of the bank note sandwiching/swiveling section 405 are respectively connected to the control unit 520. Further, the bank note extracting section 407 is connected to the control unit 520.

Figure 27:
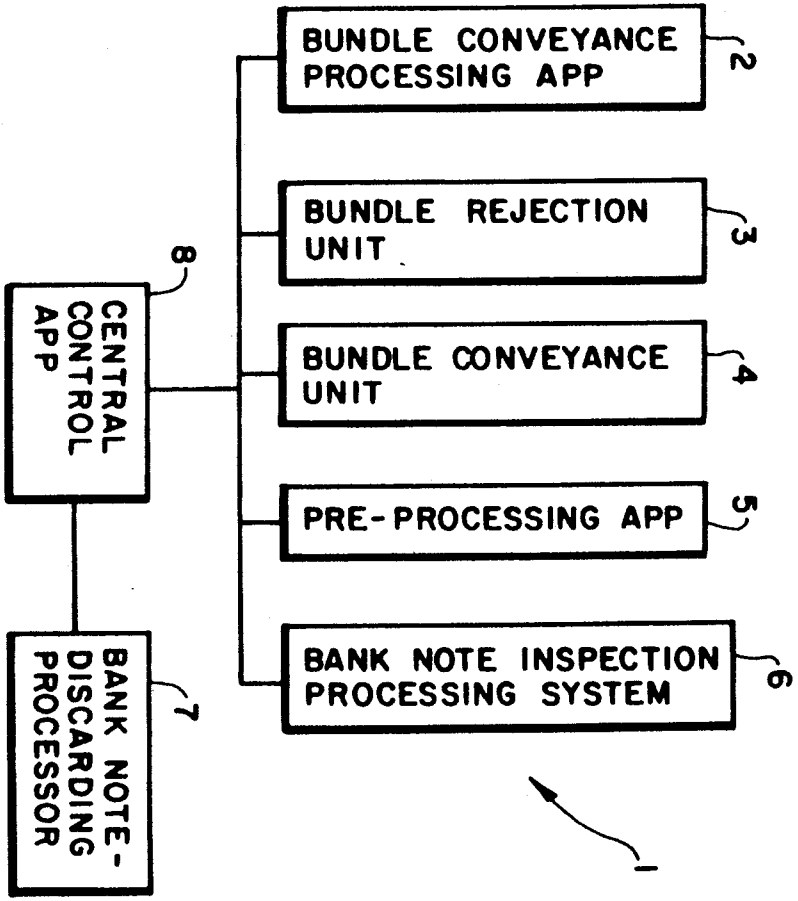
FIG. 27 is a block diagram illustrating a bank note inspection processing system including the apparatus of this invention.

The bundle processing apparatus 2, the rejection unit 3, the bundle transfer unit 4, the pre-processing apparatus 5, the inspection apparatus 6, the rejectionable bank note processor 7 are respectively connected to the central control apparatus 8, as shown in FIG. 27.

The operation of the band removing apparatus 400 will be described. In FIG. 18, when the sheaf H is transferred in the A direction by the sheaf transfer section 401, the sheaf H is detected by the first sheaf sensor 411. The sensor 411 sends a sheaf detecting signal to the sheaf processing control unit 520. The small band cutter 412 then rotates and cuts the small band K in accordance with a control signal sent from the control unit 520. The sheaf H with the thus cut small band K is further transferred in the direction of the arrow, and detected by the second sheaf sensor 417. The sensor 417 sends a sheaf detecting signal to the control unit 520. The motor 418 then drives the eccentric idler 419 and the pin 420 to rotate in accordance with a control signal sent from the control unit 520. Thus, the scraper member 415 also rotates using the support 413 as a fulcrum.

Figure 22A:
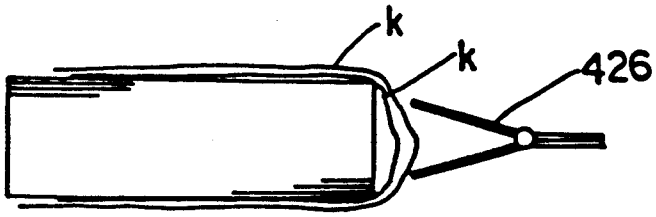
FIGS. 22A through 22D are diagrams for explaining the operation of removing a small band by use of the catch shown in FIG. 21.
Figure 22B:
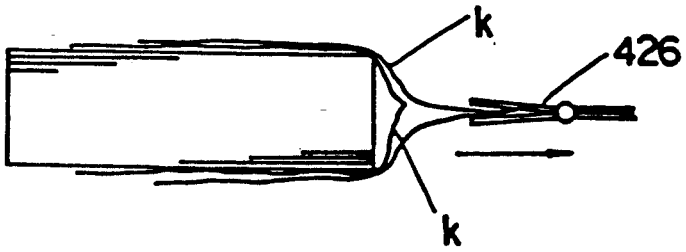
Figure 22C:
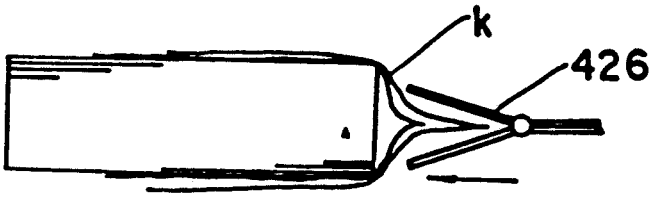
Figure 22D:
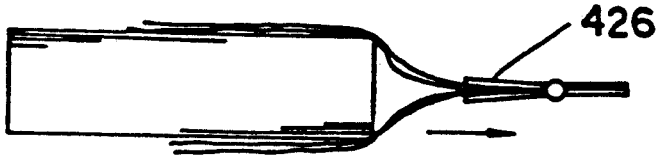

As a result, the scraper 414 penetrates between the bank notes C and the small band k so as to partially scrape the small band k from the band note C, as shown in FIG. 19. Thereafter, the reverse rotation of the motor 418 retracts the scraper 414, and leaves the small band k around the bank notes C. The bank notes C with the thus partially scraped small band k are transferred by the sheaf transfer section 401 in the arrow A direction, as shown in FIG. 18. The third sheaf sensor 421 detects the presence of such bank notes with the partially scraped small band k. Upon the detection of this, the band removing section 403 starts removing the small band k. Specifically, as shown in FIG. 22*a*, the catch 426 in an open state reaches the bank notes C with the scraped small band k. The catch 426 sandwiches the small band k, and draws out the same, as shown in FIG. 22*b*. The catch 426 then opens and returns toward the bank notes C, as shown in FIG. 22*c*. Thereafter, the catch 426 again sandwiches the small band k and draws out the same, as shown in FIG. 22*d*. More specifically, the catch 426 reaches the bank note C, as shown in FIG. 22*a* by the action of the motor 454 and the belt 447, as shown in FIG. 20. Further, the catch 426 sandwiches the bank notes C, as shown in FIG. 22*b* because the rotational solenoid 429 is energized to rotate in a direction S, as shown in FIG. 21. As a result, the first and second contacts 439*a* and 439*b* come closer so as to shut the catch 426 (see FIG. 21). The movements of the catch 426 shown in FIGS. 22*b* and 22*c* can be achieved by the reverse and forward rotations of the motor 454 shown in FIG. 20. Further, the closing (i.e., sandwiching of the small band k) and opening of the catch 426 can be achieved by energizing and de-energizing the rotational solenoid 429 shown in FIG. 21. As described above, the catch 426 sandwiches and draws out the small band k twice, as shown in FIGS. 22*b* and 22*d*. Thus, the small band k can be removed effectively.

The catch 426 in the state of sandwiching the small band k is transferred in a direction of arrow X by the small band-transferring unit 424, as shown in FIG. 20. Specifically, in FIG. 20, the clockwise rotation (observed from top) of the motor 454 causes the catch 426 to penetrate into the narrower space 451 between the catch guide boards 450*a* and 450*b*. The narrower space 451 maintains the catch 426 to securely sandwich the small band K even after the catch 426 has been separated from the first and second contacts 439*a* and 439*b* of FIG. 21. This is because the rollers 426*a* and 426*b* of the catch 426 are always constrained by the catch guide boards 450*a* and 450*b* while the catch 426 is passing through the narrower space 451. When the catch 426 has reached the broader space 452, the rollers 426*a* and 426*b* are freeed from the constraint by the catch guide boards 450*a* and 450*b*. On the other hand, the catch sensor 463 has detected the arrival of the catch 426 and sent a catch detecting signal to the control unit 520. Upon the reception of this catch detecting signal, the control unit 520 causes the motor 483 to rotate the pinion 484. Thus, the rack 481 is moved so as to vertically lower the band-depressing members 486 and 487, as shown in FIG. 23.

As a result, the member 487 depresses the small band k onto the small band-placing board 469. Thereafter, the control unit 520 caused the motor 474 to rotate the arm 475 with the pin 475*a* projected therefrom. The pin 475*a* is engaged with the elongated hole 479 of the vertical piece 476*a*. Thus, the slide lever 476 and the three small band-cramming members 478 are moved along the elongated holes 469*a*. As a result, the small band k placed on the board 469 is crammed into the small band-storing box 462, as shown in FIG. 23. The band notes C, whose small band k had been removed by the band removing section 403, are then transferred to the bank note-sandwiching/swiveling section 405, as shown in FIG. 18. The bank notes C are then detected by the sensor 504, which sends a bank note-detecting signal to the control unit 520. Upon the reception of this signal, the control unit 520 causes the motor 501 to rotate the arm 502 and the pin 503 in a direction of arrow $\alpha 1$, as shown in FIG. 24. The pin 503 is engaged with the elongated hole 496*b* made in the bent piece 496*a* of the upper sandwiching member 496. Thus, the member 496 is moved using the support piece 494 as a fulcrum in a direction of arrow $\alpha 2$ reverse to the arrow $\alpha 1$, as shown in FIGS. 24 and 25A. As a result, the bank notes C are sandwiched between the sandwiching pieces 499 and 498 provided on the upper and lower sandwiching members 496 and 493, as shown in FIG. 25B. When the motor 501 further rotates in the $\alpha 1$ direction, the upper sandwiching member 496 can no longer rotate in the $\alpha 2$ direction. This is because the pin 503 has reached the end of the elongated hole 496*b*. As a result, both the upper and lower sandwiching members 496 and 493 are intergrally swiveled using the shaft 492 as a fulcrum in the $\alpha 1$ direction, as shown in FIG. 25C. Therefore, the bank notes C sandwiched between the members 496 and 493 are swiveled up to a prescribed position, and held at the same position.

Consequently, the bank notes C make contact with the residual band-scraping members 510. The members 510 are rotated by the motor 513 in a direction of arrow $\beta$, as shown in FIG. 25C. Thus, any residual band left between the bank notes C are completely scraped off. Thereafter, the control unit 520 causes the motor 501 to rotate in the reverse direction of arrow $\alpha 1$. Thus, the bank notes C are returned to the original position, and then released from being sandwiched in the manner reverse to the above-described manner. Further, and bank notes C are pushed by a pusher (not shown), and transferred to a bank note-extracting section 407, as shown in FIG. 18. Thereafter, the section 407 extracts the bank notes C sheet by sheet, and transfers the same to the inspection apparatus 6, as shown in FIG. 18.

Figures 28A, 28B, 28C:
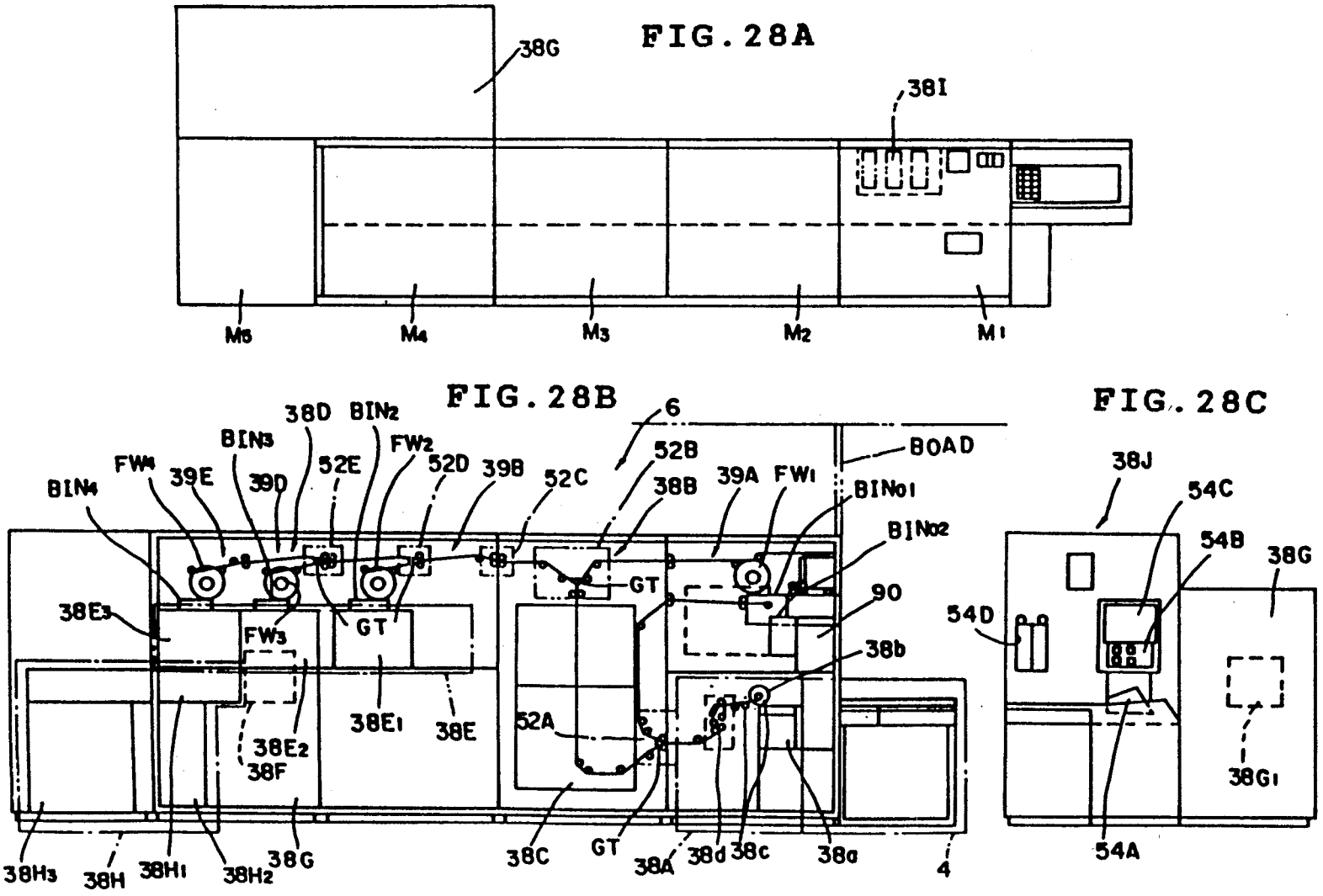
FIGS. 28A through 28C are respectively a plan view, a cross-sectional view and a side view, illustrating a bank note inspection processing system wherein the apparatus of this invention is employed.
Figure 29:
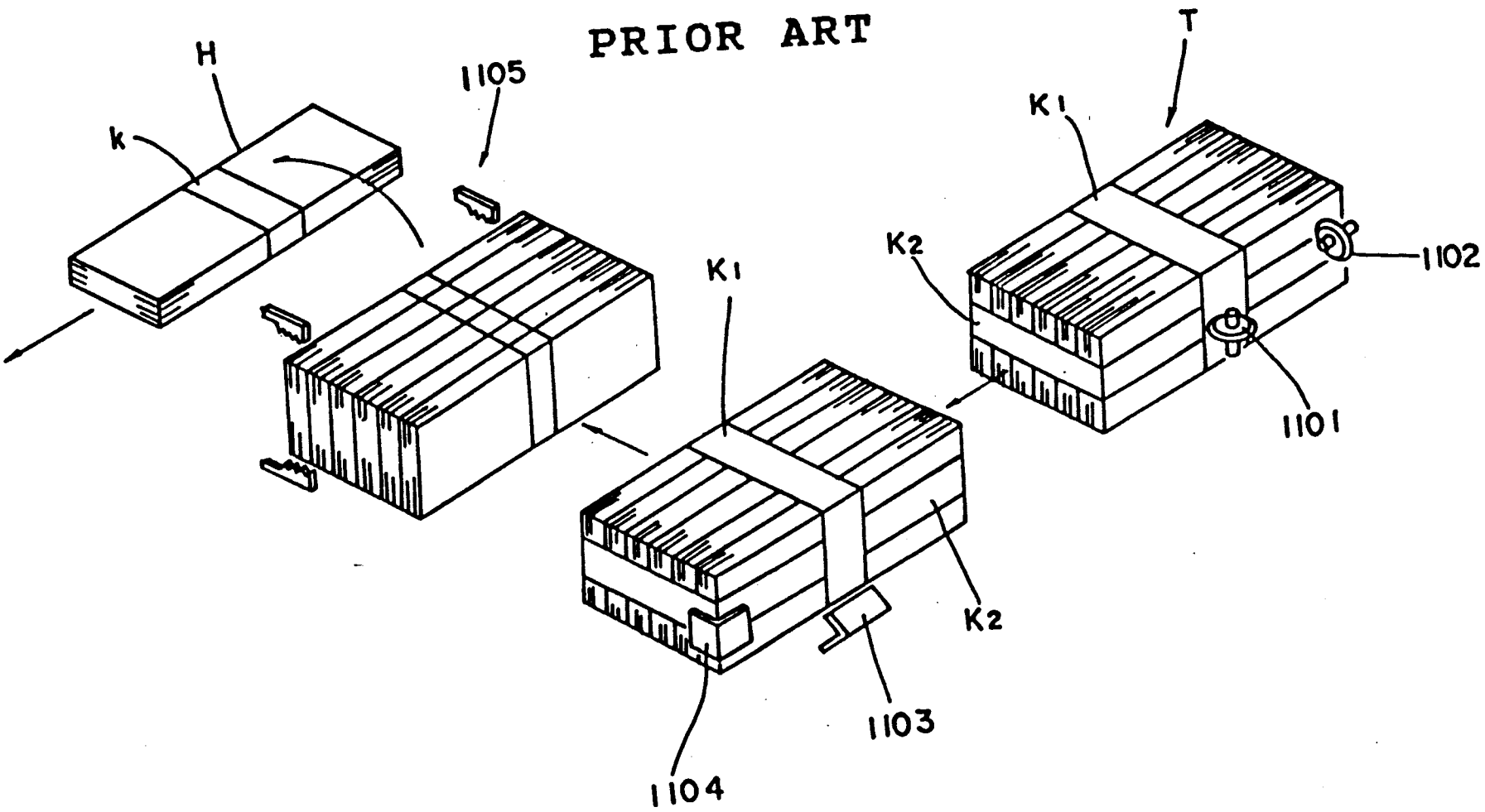
FIG. 29 PRIOR ART
FIG. 29 is a schematic diagram illustrating a conventional bank note bundle processing apparatus.

The inspection apparatus 6 will be briefly described with reference to FIGS. 28A through 28C, which are a plan view, a vertical side sectional view and a front view, respectively. The inspection apparatus 6 comprises a take-out unit 38A, a conveyor/sorter 38B, an inspection unit 38*c*, a sorter/collector 38D, a sheaf-banding unit 38E, a bundle-banding unit 38F, a bundle-packaging unit 38G, and a destroying unit 38H, as shown in FIG. 28B. The inspection apparatus 6 further comprises a control unit 38I, and an operation/display unit 38J, as shown in FIGS. 28A and 28C, respectively. Further, the apparatus 6 comprises a noise-preventing wall board provided between the take-out unit 38A and the operation/display unit 38J, as shown in FIG. 28B.

Thus, the operation/display unit 38J can be protected from the noise generated by the mechanism section including the units and devices 38A through 38H. The sorter/collector 38D comprises a rejected bank note-sorting/collecting unit 39A, a different bank note-sorting/collecting unit 39B, a correct bank note-sorting-/collecting unit 39D, and an unfit bank note-sorting-/collecting unit 39E. The conveyor/sorter 38B comprises five conveyor/sorter units 52A through 52E in the conveyor path, corresponding to the units 39A, 39B, 39D and 39E of the sorter/collector 38D, respectively. Further, gates GT are provided at the respective divided portions of the conveyor/sorter unit 52A through 52E. The units 39A, 39B, 39D and 39E are provided with conventional recovery wheels FW1 through FW4, respectively. The wheels FW1 through FW4 take-out the bank notes, which have been transferred, sheet by sheet so as to collect the same in their corresponding collecting boxes BINs. Specifically, a counterfeit bank note-collecting box BIN01 and an unmachinable bank note-collecting box BIN02 are disposed at the upper and lower portions of the rejected bank note-sorting/collecting unit 39A. Further, other collecting boxes BIN2 through BIN4 are respectively disposed at the different bank note-sorting/collecting unit 39B, the correct bank note-sorting/collecting unit 39D, and the unfit bank note-sorting/collecting unit 39E. The sheaf-banding unit 38E comprises sheaf-banding devices 38E1, 38E2 and 38E3 disposed respectively under the collecting boxes BIN2 through BIN4. The bundle-banding unit 38F is provided under the sheaf-banding device 38E2, which is disposed under the correct bank note-sorting/collecting unit 39D. The unit 38F has a window through which the banded bundle is fed into the bundle-packaging unit 38G disposed under the Unit 38F, as shown in FIG. 28B. Now, referring back to the take-out unit 38A, the unit 38A comprises a loose bank note-collecting unit 38*a*, and a delivery roller 38*b* for picking up one by one the bank notes collected in the unit 38*a*. The unit 38A further comprises a group of conveyor rollers 38*c* for transferring the bank notes picked up by the delivery roller 38*b*. Further, the unit 38A comprises a checking unit provided in the conveyor path for checking the bank notes in terms of unmachinable characteristics (e.g., superposition, skew, short pitch, etc). The checking is performed in accordance with a prescribed check list and the results thereof are stored in a memory 220 in the control unit 38I. The results of the inspection unit 38C are also stored in the memory 220. The take-out unit 38A is prevented from picking up the individual bank notes of a subsequent sheaf before the processing of a preceding sheaf is completed. The operation/display unit 38J comprises an inlet portion 54A for fed sheaves, and an operating portion 54B including a ten-numerical input pad above the inlet portion 54A. Further, the unit 38J comprises a monitoring CRT 54C and a cassette outlet opening 54D, as shown in FIG. 28C. The bundle-packaging unit 38G has an outlet opening 38G1, as shown in FIG. 28B.

The sections containing the above-described units are respectively incorporated in modules M1 through M5, as shown in FIG. 28A. Specifically, a feeding module M1 detachably fitted with a feeding stand 86, an inspection module M2, first and second collecting modules M3 and M4, a scrapping module M5, and the bundle-packaging unit 38G are arranged so that they can be attached to or detached from one another. Thus, these modules can be optionally increased or decreased in number depending on applications and functions required. The feeding module M1 incorporates the rejected bank note-sorting/collecting unit 39A and the take-out unit 38A arranged vertically, and the control unit 38I behind them, as shown in FIG. 28B. The inspection module M2 contains the inspection unit 38C, and the first and second conveyor/sorters 52A and 52B. The first collecting module M3 incorporates the different bank note-sorting/collecting unit 39B, the sheaf-banding unit 38E, and the third and fourth conveyor/-sorters 52C and 52D. The second collecting module M4 incorporates the correct bank note-sorting/collecting unit.39D and the sheaf-banding device 38E2. The module M4 further incorporates the unfit bank note-sorting-/collecting unit 39E, the sheaf-banding device 38E3, and the conveyor/sorter units 52E. Further, the module M4 incorporates shredders 38H1 and 38H2 as first and second destroying devices. The scrapping module M5 contains a scrap box 38H3. A rejected bank note cassette which serves as a rejected bank note storing unit is provided in the vicinity of the two boxes BIN01 and BIN02.

As described above, according to the present invention, a series of processes starting with the removal of large bands from a received bundle to the one-by-one extraction of the sheaves can be smoothly performed. In particular, a plurality of bundles can be continuously received and processed. Thus, the efficiency of bank note processing can be significantly enhanced. Moreover, in this embodiment, the bank note bundle processing has been described. However, this invention may also be widely applied to paper sheet bundle processing apparatus wherein paper sheets similar to bank notes are processed.

Obviously, numerous additional modifications and variations of the present invention are possible in light of the above teachings. It is therefore to be understood that within the scope of the appended claims, the invention may be practiced otherwise than as specifically described herein.

What is claimed is:

1. A paper sheet bundle processing apparatus for processing received bundles bound with large bands, each bundle having a predetermined number of sheaves, each sheaf being bound with a small band, said apparatus comprising:

means for conveying said bundles;

large band removing means, positioned at a first position other than said conveying means, for removing significant portions of said large bands from said bundles;

first transferring means for transferring one of said bundles between said conveying means and said large band removing means;

sheaf storing means, disposed at a position different from said large band removing means, for storing a predetermined number of sheaves after said significant portions of said large bands have been removed by said large band removing means;

sheaf withdrawing means, disposed at a position different from said sheaf storing means and said large band removing means, for withdrawing said sheaves, one by one; and second transferring means, positioned at a second position different from said first position and said sheaf storing means, for transferring said predetermined number of sheaves from said sheaf storing means to said sheaf withdrawing means such that said sheaf withdrawing means, operating independently from said large band removing means, can withdraw sheaves from a first bundle at the same time that said removing means removes said significant portions of said large bands from a second bundle.

2. The apparatus of claim 1, wherein said large band removing means includes:

means for cutting the large bands, means for separating, from said bundles, the large bands cut by said large band cutting means, and large band drawing means for drawing, out of said bundles, significant portions of said large bands separated from said bundles.

3. The apparatus of claim 2 further comprising means for pushing the large bands separated from said bundles into said large band drawing means.

4. The apparatus of claim 1 further comprising means for removing residual portions of said large bands remaining on said sheaves after said significant portions of said large bands have been removed.

5. The apparatus of claim 1 further comprising small band removing means for removing the small bands from said sheaves extracted by said sheaf withdrawing means.

6. The apparatus of claim 5, wherein said small band removing means includes:

small band cutting means for cutting said small bands, means for separating, from said sheaves, said small bands cut by said small band cutting means, and small band drawing means for drawing said small bands, separated from said sheaves, out of said sheaves.

7. The apparatus of claim 6, wherein said small band drawing means includes:

small band gripping means for gripping the cut small band, transfer means for moving said small band gripping means away from a sheaf, and guide means for automatically causing said small band gripping means to maintain gripping while being transferred and for automatically causing said small band gripping means to open when transfer is completed.

8. The apparatus of claim 7 further comprising means for removing residual portions of said large bands remaining on said sheaves after said significant portions of said large bands have been removed.

9. The apparatus of claim 7, wherein said sheaf withdrawing means comprises sheaf catching means for catching a sheaf being present at an end of said predetermined number of sheaves, and means for swiveling a sheaf sandwiching means by a prescribed angle.

10. The apparatus of claim 1, wherein said sheaf withdrawing means includes:

sheaf catching means for catching a sheaf being present at an end of said predetermined number of sheaves, and means for swiveling a sheaf sandwiching means by a prescribed angle.

11. A paper sheet bundle processing apparatus for processing received bundles bound with large bands, each bundle having a predetermined number of sheaves bound individually with a small band, said apparatus comprising:

first transfer means for transferring said received bundles;

bundle positioning means for positioning a bundle transferred by said first transfer means at a prescribed position;

second transfer means for moving said bundle positioning means together with said bundle positioned by said positioning means;

large band cutting means for cutting said large bands of said bundle transferred by said second transfer means;

large band removing means for removing a significant portion of said large bands cut by said large band cutting means from said bundle, said large band removing means comprising means for catching said large bands and means for pushing said large bands into said means for catching said large bands;

large band storing means for storing said significant portion of said large bands removed by said large band removing means;

third transfer means for transferring bundles whose said significant portion of said large bands have been removed by said large band removing means;

means for removing residual portions of said large bands remaining on said bundles transferred by said third transfer means;

fourth transfer means for transferring a bundle whose said residual portions of said large bands have been removed by said means for removing residual portions of said large bands;

sheaf separating means for separating a sheaf from sheaves included in said bundle transferred by said fourth transfer means;

fifth transfer means for transferring said sheaf separated by said sheaf separating means;

small band cutting means for cutting a small band of said sheaf transferred by said fifth transfer means;

small band removing means for removing said small band cut by said small band cutting means from said sheaf;

small band storing means for storing said small band removed by said small band removing means;

paper sheet inspecting means for inspecting paper sheets of said sheaf whose small band has been removed by said small band removing means; and paper sheet sorting means for sorting said paper sheets in accordance with inspection results provided by said paper sheet inspecting means.

12. A paper sheet bundle processing apparatus for processing received bundles bound with large bands, each bundle having a predetermined number of sheaves, each sheaf being bound with a small band, said apparatus comprising:

large band removing means for removing significant portions of said large bands from said bundles, said large band removing means comprising:

means for cutting said large bands means for separating from said bundles said large bands cut by said large band cutting means, large band drawing means for drawing out of said bundles significant portions of said large bands separated from said bundles, and means for pushing said large bands separated from said bundles into said large band drawing means;

sheaf storing means for storing said predetermined number of sheaves after said significant portions of said large bands have been removed by said large band removing means; and sheaf withdrawing means for receiving said predetermined number of sheaves from said sheaf storing means and withdrawing said sheaves, one by one, from said bundles.

13. A paper sheet bundle processing apparatus for processing received bundles bound with large bands, each bundle having a predetermined number of sheaves, each sheaf being bound with a small band, said apparatus comprising:

large band removing means for removing significant portions of said large bands from said bundles;

sheaf storing means for storing said predetermined number of sheaves after said significant portions of said large bands have been removed by said large band removing means;

sheaf withdrawing means for receiving said predetermined number of sheaves from said sheaf storing means and withdrawing said sheaves, one by one, from said bundles; and small band removing means for removing said small bands from said sheaves extracted by said sheaf withdrawing means, said small band removing means comprising:

small band cutting means for cutting said small bands, means for separating from said sheaves said small bands cut by said small band cutting means, and small band drawing means for drawing said small bands separated from said sheaves out of said sheaves, said small band drawing means comprising:

small band gripping means for gripping the cut small band, transfer means for moving said small band gripping means away from a sheaf, and guide means for automatically causing said small band gripping means to maintain gripping while being transferred, and for automatically causing said small band gripping means to open when transfer is completed.

* * * * *